United States Patent [19]

Kirsch

[11] 4,226,439

[45] Oct. 7, 1980

[54] SAFETY SKI-BINDINGS

[76] Inventor: Bernhard Kirsch, Im LItzelholz 23, 5500 Trier-Biewer, Fed. Rep. of Germany

[21] Appl. No.: 919,180

[22] Filed: Jun. 26, 1978

[30] Foreign Application Priority Data

| | | | |
|---|---|---|---|
| Jun. 27, 1977 | [DE] | Fed. Rep. of Germany | 2728917 |
| Jun. 27, 1977 | [DE] | Fed. Rep. of Germany | 2728918 |
| Dec. 31, 1977 | [DE] | Fed. Rep. of Germany | 2759144 |
| Dec. 31, 1977 | [DE] | Fed. Rep. of Germany | 2759145 |

[51] Int. Cl.[2] ..... A63C 9/08

[52] U.S. Cl. ..... 280/628; 280/627; 280/636

[58] Field of Search ..... 280/628, 626, 636, 617, 280/627, 623, 618, 611, 616, 631, 632

[56] References Cited

U.S. PATENT DOCUMENTS

| | | | |
|---|---|---|---|
| 3,693,989 | 9/1972 | Forcht | 280/628 |
| 3,819,200 | 6/1974 | Schweizer | 280/636 |
| 3,920,256 | 11/1975 | Sittmann | 280/628 |
| 4,113,276 | 9/1978 | Kirsch | 280/618 |

FOREIGN PATENT DOCUMENTS

| | | | |
|---|---|---|---|
| 272907 | 7/1969 | Austria | 280/626 |
| 1478096 | 5/1969 | Fed. Rep. of Germany | 280/626 |

*Primary Examiner*—David M. Mitchell

*Attorney, Agent, or Firm*—Robert W. Beach; Ward Brown

[57] ABSTRACT

This invention relates to a safety ski-binding of the kind comprising a heel binding and a front binding including sole-clamps to hold down the toe portion of the sole of a ski-boot. According to the invention, the sole-clamps are mounted to tilt about a pivot shaft which is arranged to extend transversely to the longitudinal direction of the ski, when mounted, below the plane of the bottom of the sole of the ski-boot, and they are capable of pivoting to a position in which they point forwards towards the point of the ski and are situated below the plane of the bottom of the sole of the boot. Moreover, each of the sole clamps has an abutment which retains the boot sole in the longitudinal direction of the ski, and a lug which retains the sole of the boot in a direction perpendicular to the plane of the sole, and furthermore the sole clamps are connected to a locking arrangement which permits them to perform their pivoting movement when a pressure threshold is exceeded.

57 Claims, 63 Drawing Figures

Fig.1
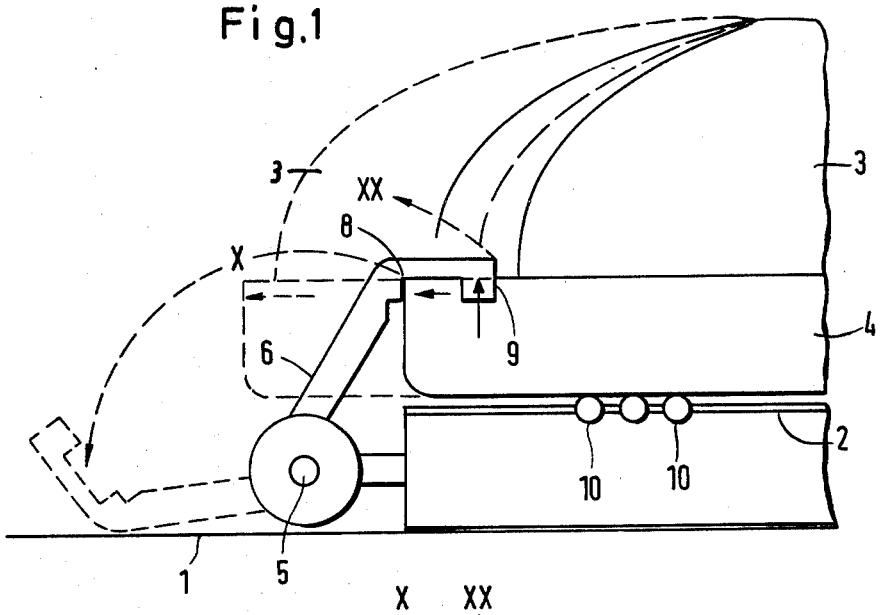
Fig.3
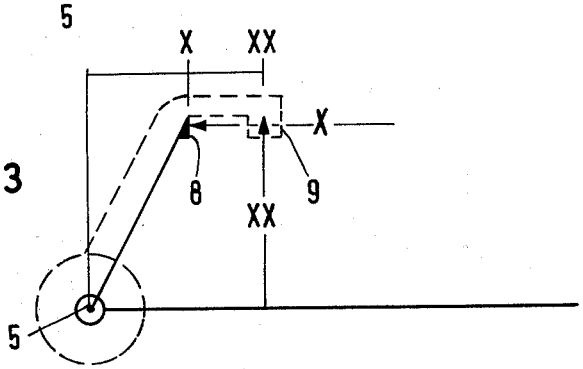
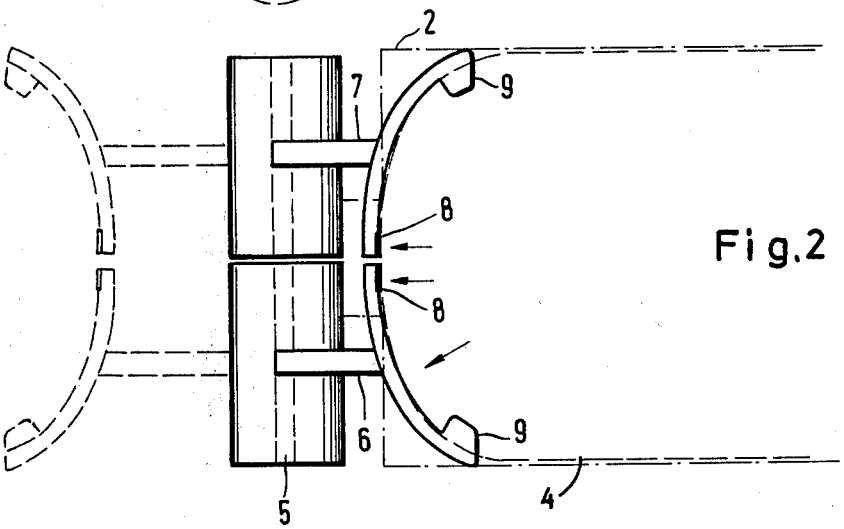
Fig.2

Fig.15
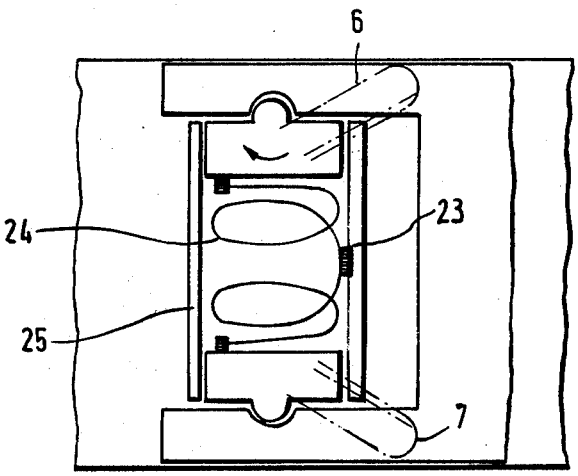
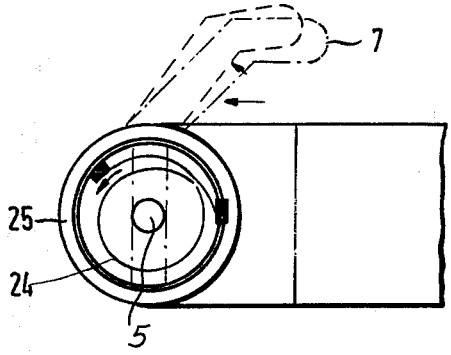
Fig.16

Fig.21
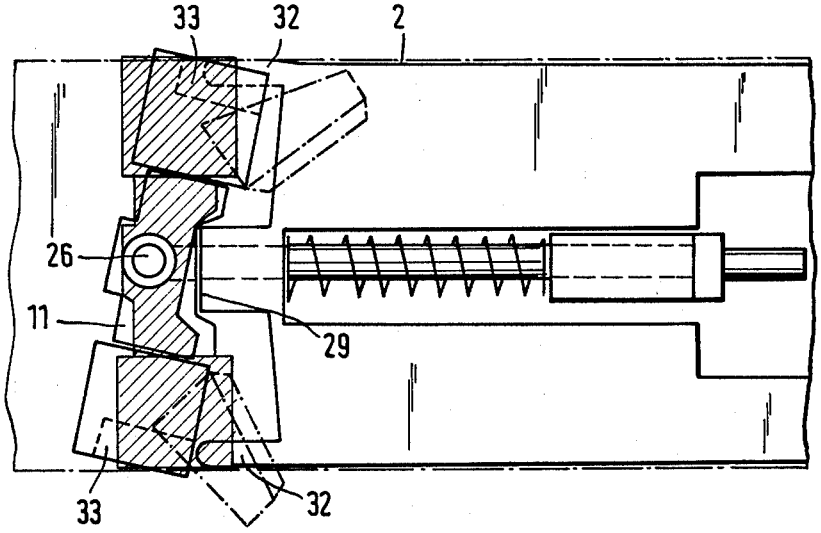
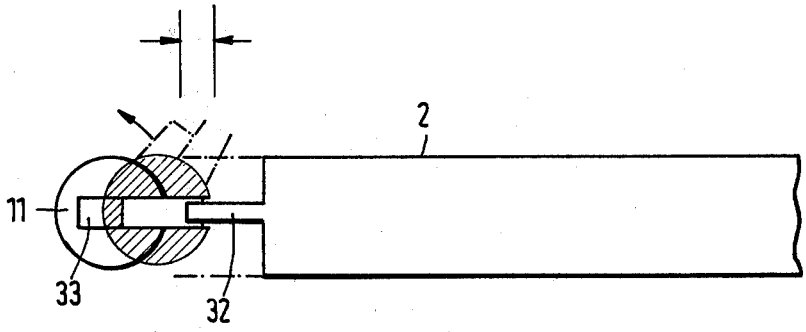
Fig.22

Fig.25
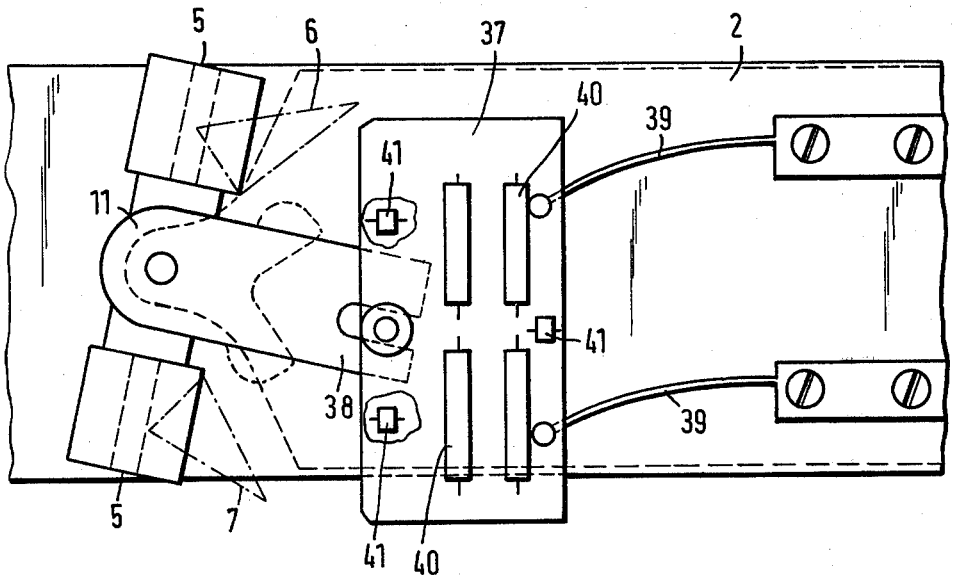
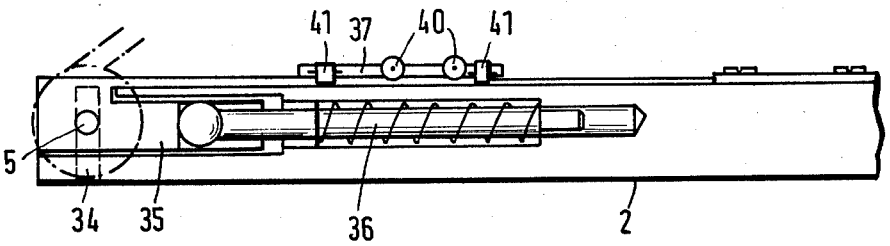
Fig.26

Fig.27
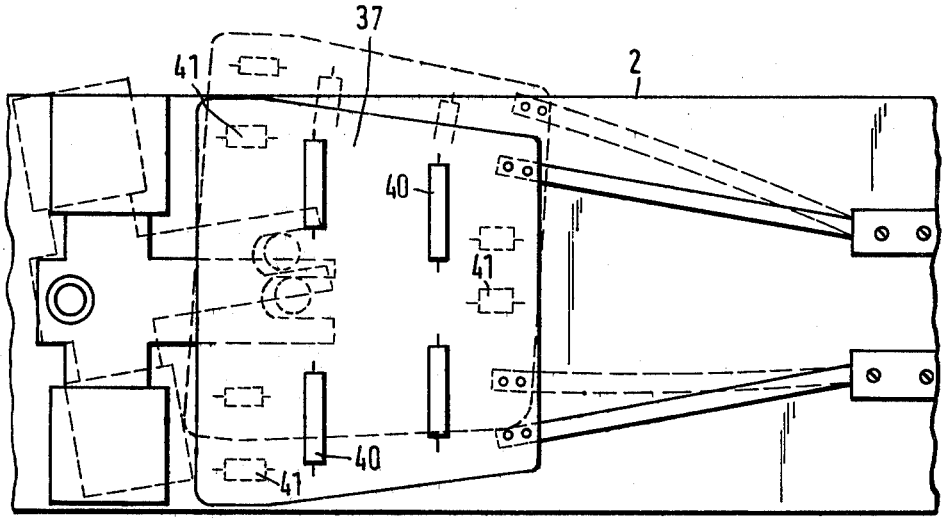
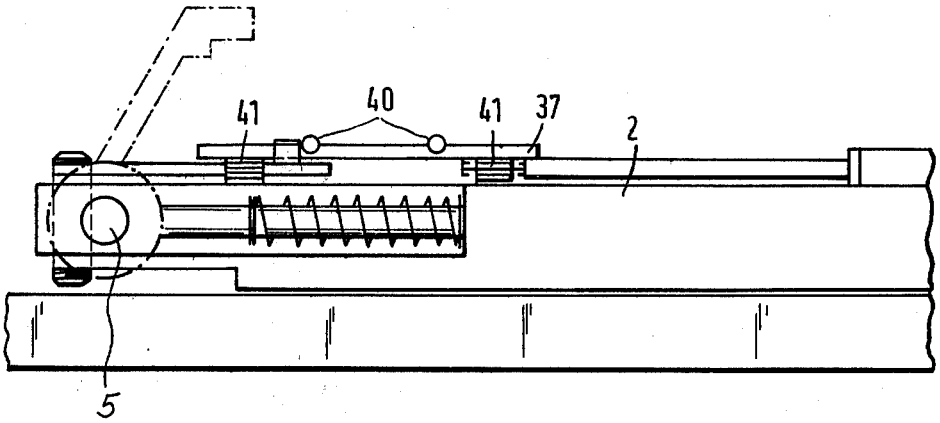
Fig.28

Fig.30
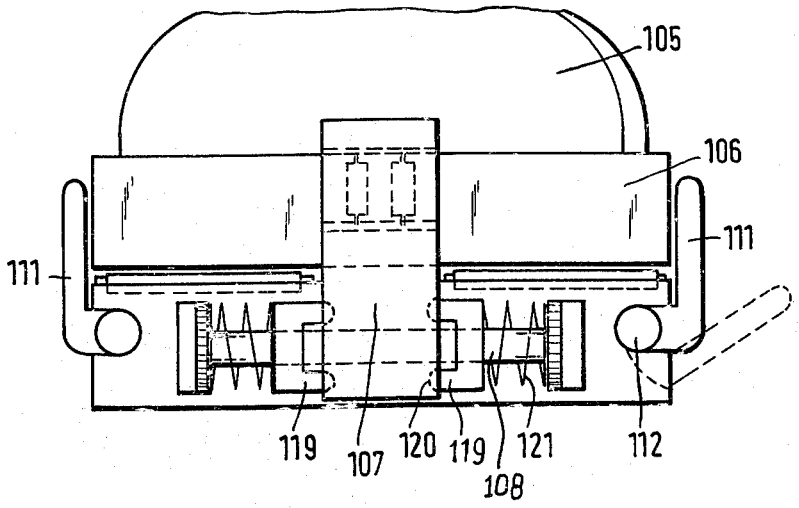
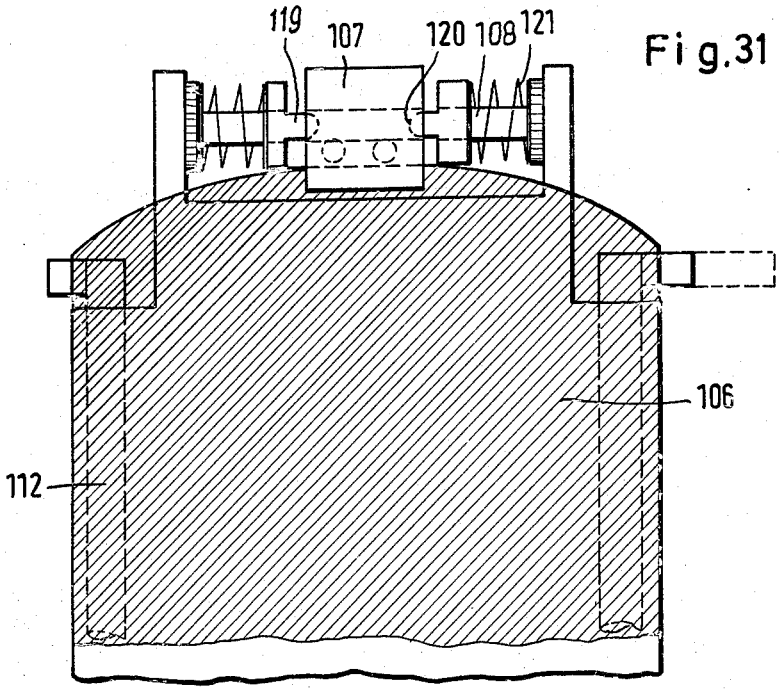
Fig.31

Fig.34
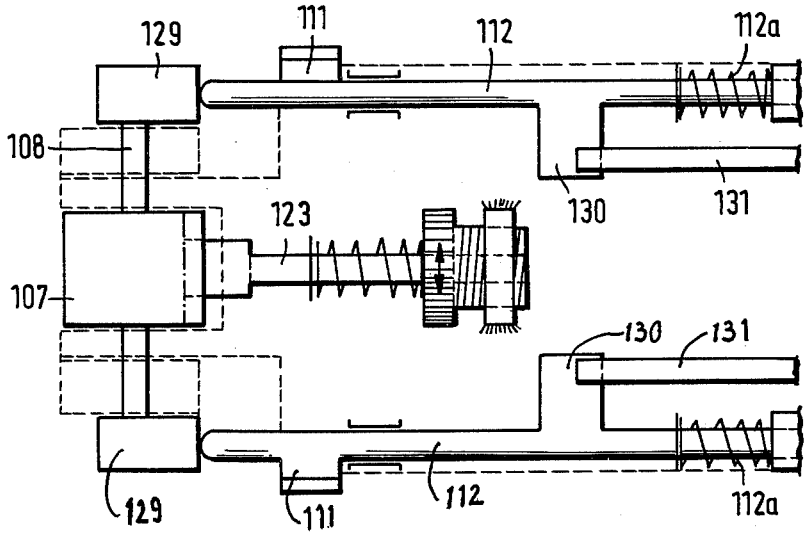
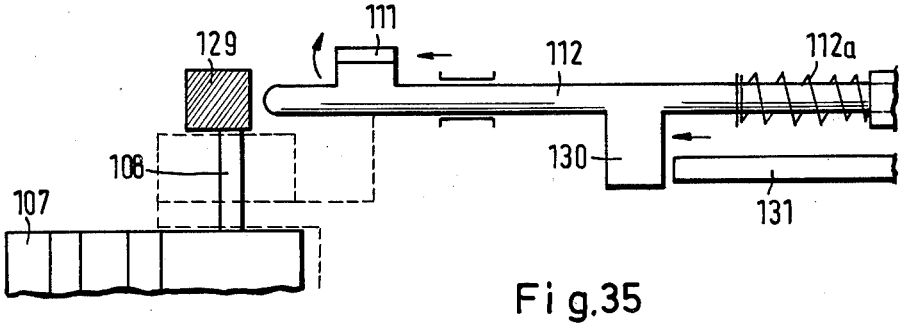
Fig.35

Fig.36
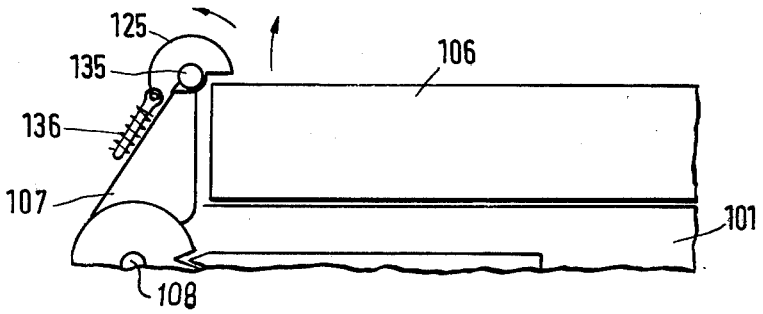
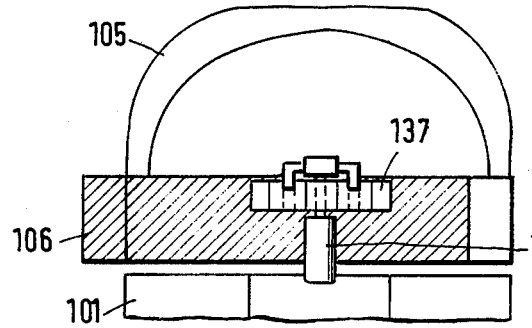
Fig.40
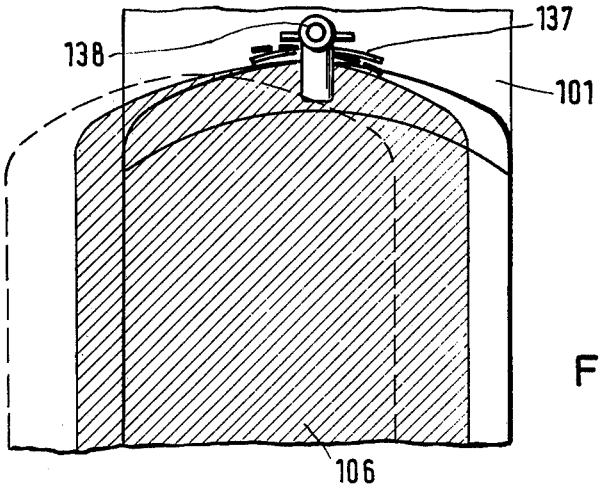
Fig.41

Fig.42
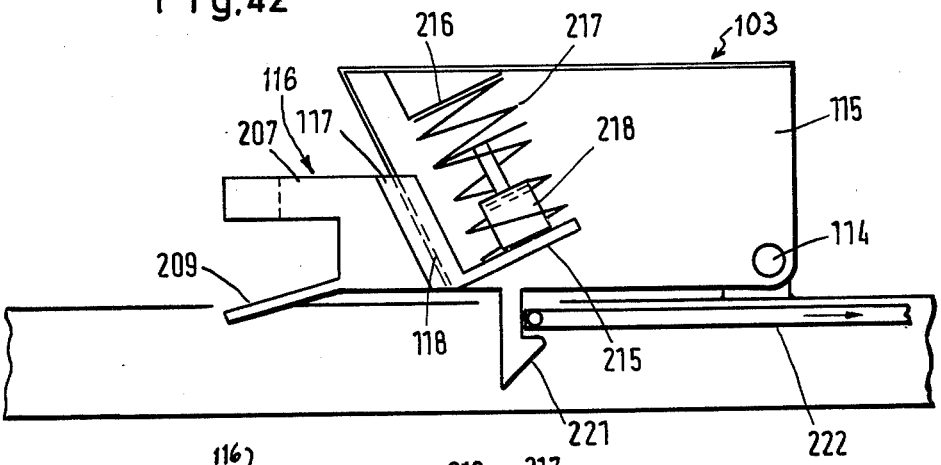
Fig.43
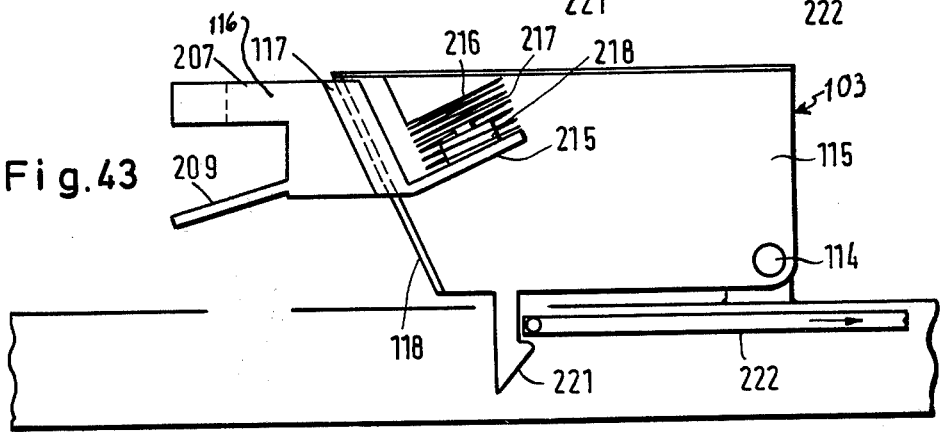
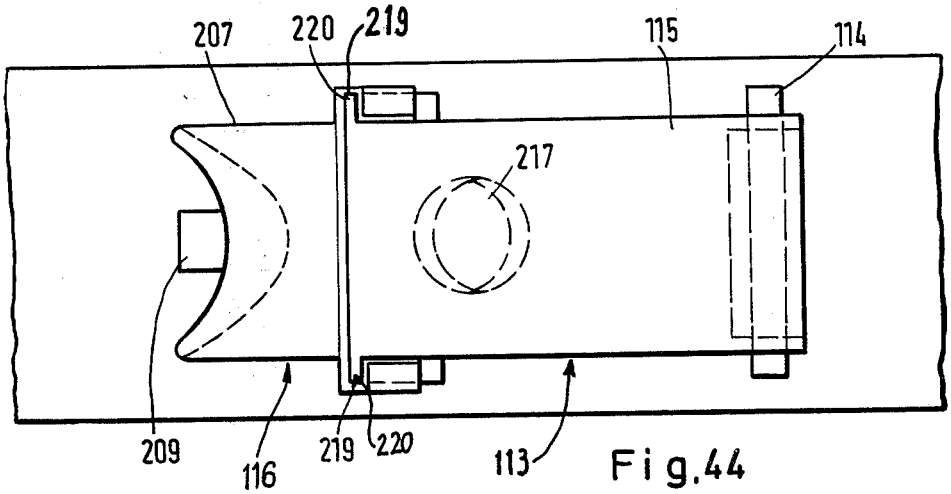
Fig.44

Fig.56
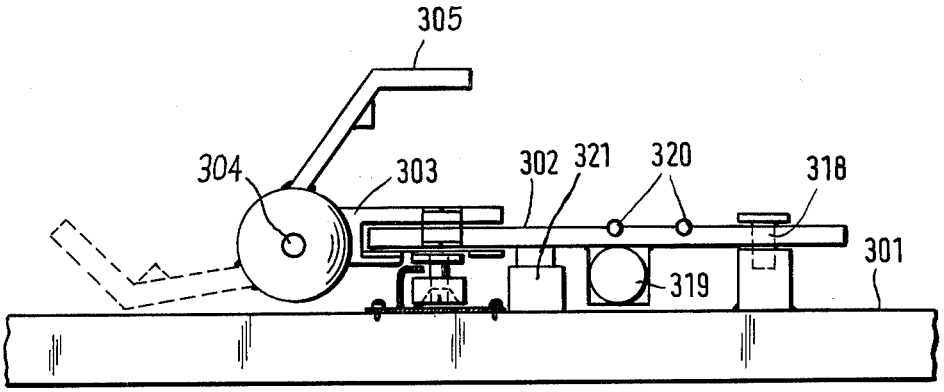
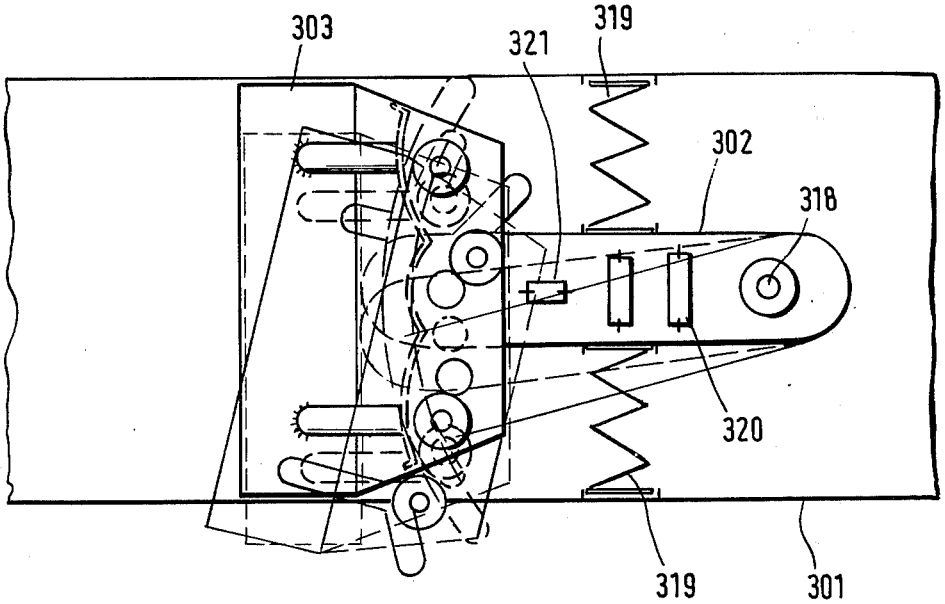
Fig.55

Fig.61
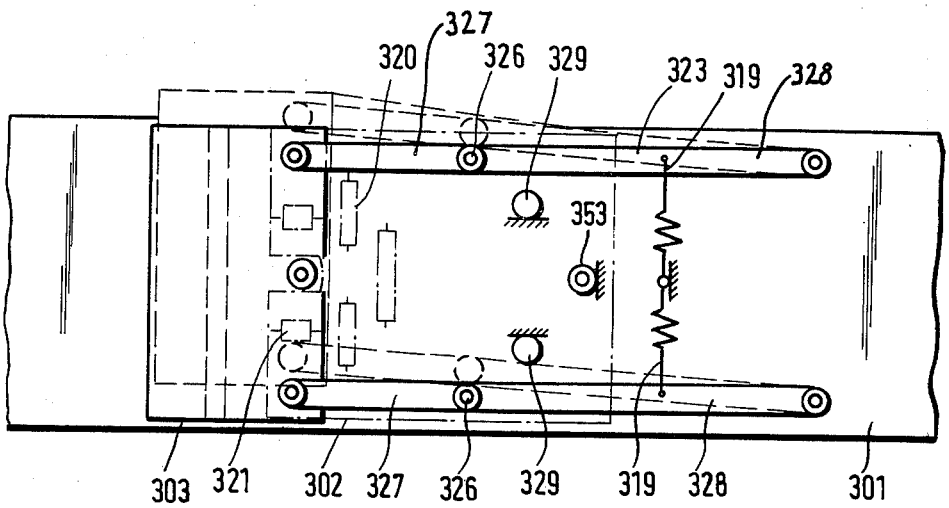
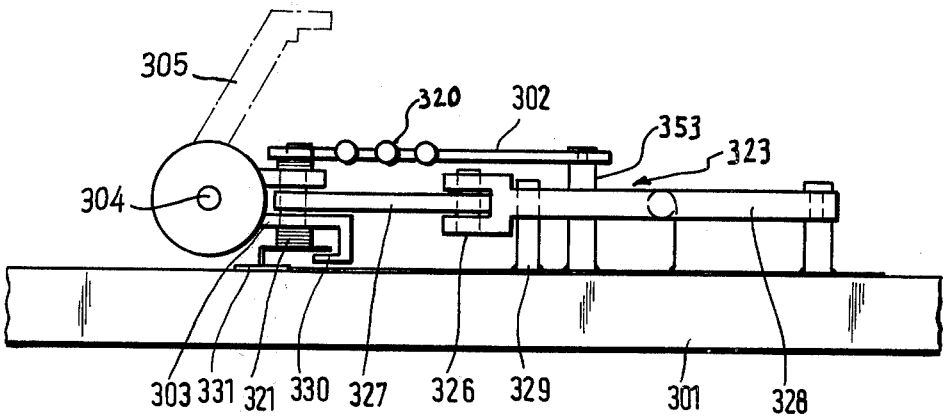
Fig.62

SAFETY SKI-BINDINGS

BACKGROUND OF THE INVENTION

The present invention relates to a safety ski-binding comprising and a heel binding and a front binding including clamps to hold down the toe portion of the sole of a ski-boot.

It is considered a disadvantage of known ski-bindings that even when the front binding has opened, the ski-boot cannot slide forward towards the point of the ski because the front binding is arranged in front of the toe of the ski-boot.

Ski-bindings do in fact exist in which it is possible for the ski-boot to slide out forwards, but these only operate when a sufficiently great pressure in the direction of movement is exerted on the front binding, as occurs in the event of head-on impact against an obstacle. The front binding does not however open when the skier falls sideways or backwards (a fall on the back) as often happens. In such cases the front binding holds the ski-boot so firmly that injury may result. Also, these known safety bindings often fail to release in the event of a forward fall from an upright or stationary position.

It is therefore an object of the invention to provide a ski-binding of the kind described above in such a way that it is possible for the ski-boot to slide out forwards without obstruction both in the event of head-on impact against an obstacle and in the event of a sideways fall or a fall on the back or a forward fall from an upright or stationary position.

SUMMARY OF THE INVENTION

This and other objects are achieved by mounting the sole-clamps in such a way that they are able to tilt about a pivot shaft extending tranversely to the longitudinal direction of the ski below the plane of the bottom of the sole of the ski-boot, the sole-clamps then pivoting to a position in which they are situated below the plane of the bottom of the sole of the boot and in which they point forward towards the point of the ski, by providing the sole-clamps with an abutment which retains the sole of the boot in the longitudinal direction of the ski and a lug which retains the sole of the boot in a direction perpendicular to the plane of the sole of the boot, and by connecting the sole-clamps to a locking arrangement which permits the pivoting movements by the sole-clamps when a pressure threshold is exceeded.

Advantageously, the arm of the sole-clamps which carries the retainer lug is longer than the arm of the sole-clamps carrying the abutment and the sole-clamps are able to tilt forward in the direction of the point of the ski independantly of one another. The sole-clamps are preferably arranged to be displaceable on the pivot shaft and preferably have lateral projections which engage in recesses in a mounting forming part of the front binding which carries the pivot shaft.

Compression springs which hold the sole-clamps in the locked position are advantageously arranged on the pivot shaft, and the sole-clamps may have a recess into which a spring-loaded pin, ball, catch or the like projects in the locked position. The sole-clamps preferably have lateral projections over which engage the ends of the arms of a U-shaped spring-clip. The sole-clamps may be connected together by a torsion and compression spring arranged on the pivot shaft.

In another embodiment, the sole-clamps are preferably connected together by a sleeve arranged co-axially with the pivot shaft.

The pivot shaft is advantageously arranged in front of the toe of the ski-boot in the direction of the point of the ski.

In a preferred embodiment, the mounting carrying the pivot shaft is arranged to pivot in opposition to the action of a pretensed spring about a shaft perpendicular to the plane of the sole of the ski-boot. The perpendicular shaft is preferably connected to a spring-loaded rod which is arranged to be displaceable in the longitudinal direction of the ski. It is advantageous for the mounting, which is displaceable in the longitudinal direction of the ski in opposition to a spring, to be held against a bearing face in such a way as to be able to pivot.

In an advantageous refinement, a roller plate carrying the part of the ski boot corresponding to the ball of the foot is arranged to pivot in a plane parallel to the plane of the sole of the boot and is hinged to the mounting. The roller plate is preferably hinged to leaf-springs arranged on the ski at a distance from one another which hold the roller plate in a central position. In the roller plate, slide-rollers are arranged to rotate about axes preferably extending transversly to the longitudinal direction of the ski. Preferably, slide rollers which are guided on the surface of the ski are arranged on the roller plate to rotate about axes extending in the longitudinal direction of the ski.

From the vertical locked position to the horizontal released position in which they point towards the point of the ski, the angle through which the sole-clamps pivot is preferably more than 80°.

In a preferred embodiment, abutments which tilt outwards about a pivot shaft extending in the longitudinal direction of the ski are arranged on either side of the sole of the boot.

Advantageously, the sole-clamp is connected to a part-ring of teeth whose points project slightly above the plane of the sliding surface for the ski-boot when the sole-clamp performs its tilting movement.

The sole-clamp is preferably connected to an eccentric which co-operates with a rod displaceable in the longitudinal direction of the ski, which rod carries the lateral abutment.

The lateral abutments are advantageously in the form of rollers having vertical axes. A roller device is advantageously arranged between the lateral abutments on a foot plate arranged between the front and heel bindings.

The sole-clamp advantageously has a top-part which grasps the sole of the boot and which can be tilted about a pivot shaft extending transversely to the longitudinal direction of the ski in opposition to resilient force. An abutment for the toe of the boot which can pivot freely about a pivot shaft lying perpendicular to the plane of the ski is advantageously arranged on the sole-clamp. The abutment is preferably arcuate in shape.

In an advantageous embodiment, in which the heel binding has a heel clamp and a foot plate firmly connected thereto which together are able to tilt upwards from the surface of the ski about a pivot shaft extending tranvsersely to the longitudinal direction of the ski after a lock has been released, the heel clamp and the foot plate are arranged on a front mounting which is movable upwards and forwards in relation to a rear part which co-operates with the pivot shaft.

By virtue of this design, the ski boot is forced to move in the direction of the front binding when there is an upwards pull on the heel away from the plane of the ski. A pull of this kind occurs for example in the event of a fall forward from an upright or stationary position, so that, with the means described, it is ensured that the front binding will release and thus free the ski-boot even in the event of such a fall.

At its rear end, the front mounting advantageously has an inclined sliding face which is displaceable on a correspondingly formed incline at the front end of the rear part. Advantageously, the front mounting has a projection against which bears one end of a spring whose other end is mounted against the rear part.

In a preferred embodiment, the spring has a change-over device for fast and slo falls. The rear edge of the front mounting preferably has a rack in which a rotatably mounted gear wheel connected to the rear part engages. The gear wheel is preferably connected to a fly-wheel.

In a further advantageous embodiment, there is arranged on the rear part a spring-loaded pin movable in the longitudinal direction of the ski whose front end has a bevel which co-operates with a bevel on the front mounting. The front mounting preferably has lateral sliders, guide rollers or the like which are guided in an inclined guide track in the rear part. The upper section of the guide track is preferably curved to the rear.

In a further advantageous embodiment, the front mounting is hinged to swinging arms or links which are hinged to the rear part. At least one swinging arm is preferably made as a bell crank whose arm remote from the front mounting is connected to one end of a compression spring whose other end bears against a projection on the rear part. Preferably, at least one swinging arm is in the form of a straight lever which is pivotable about a pivot shaft and a spring connected to the rear part engages with at least one section of the lever. The pivot shaft of at least one swinging arm is preferably mounted in an elongated hole and connected to a compression spring.

Preferably the rear part is subject to the action of a compression spring which exerts a thrust towards the front binding. The sole-clamp is preferably arranged on the front mounting in such a way as to be vertically adjustable. The force exerted by the spring is preferably adjustable also.

In another embodiment of safety ski-binding having a front binding with a mounting carrying clamps for the sole of a ski-boot and a foot plate arranged between the front and heel binding which is pivotable in a plane parallel to the plane of the sole of the boot and which is held in a central position by a holding arrangement, it is advantageous for the mounting carrying the sole clamps to be connected to the foot plate, which carries the part of the boot corresponding to the ball of the foot, in such a way as to pivot in a plane parallel to the foot plate in the opposite direction from the foot plate, when the foot plate pivots through more than a certain angle, and for the sole-clamps to be capable of tilting forwards in the direction of the point of the ski about a pivot shaft extending tranversely to the longitudinal direction of the ski below the plane of the bottom of the sole of the boot.

The mounting carrying the sole-clamps advantageously has guide pins which are mounted to move along a cam-plate secured to the ski. The guide pins preferably carry rotatable rollers in the sections associated with the cam-plate. The cam-plate advantageously has a central section extending substantially transversely to the longitudinal direction of the ski and lateral sections continuing from the latter which are set back towards the point of the ski.

In a further advantageous embodiment, bars extending in the longitudinal direction of the ski which carry the foot plate and which are arranged next to one another at a distance transversely to the longitudinal direction of the ski are hinged to the ski at the end remote from the mounting and to the foot plate at the other end.

The bars or the foot plate are advantageously connected to springs secured at one end to the ski. The bars preferably have a bending joint, the section of a bar connected to the mounting being pivotable towards the neighbouring bar. Abutments secured to the ski are advantageously provided between the bars at a distance from one another and from the bars, against which the section connected to the ski of one or other bar comes to bear when a certain angle of pivot is exceeded.

In another embodiment, leaf springs extending in the longitudinal direction of the ski which are arranged next to one another at a distance transversely to the longitudinal direction of the ski are securely connected to the ski at the end remote from the mounting and are hinged to the foot plate at the other end.

Rollers are preferably arranged on the bars or leaf springs or in the foot plate to rotate about axes extending in the longitudinal direction of the ski, which rollers rest on the surface of the ski. Rollers are advantageously arranged to rotate about axes extending transversely to the longitudinal direction of the ski in the foot plate carrying the part of the ski-boot corresponding to the ball of the foot.

BRIEF DESCRIPTION OF THE DRAWINGS

In order that the invention may be more clearly understood, reference will now be made to the accompanying drawings, which show certain embodiments and in which:

FIG. 1 is a side-view of a front binding according to the invention,

FIG. 2 is a plan view of the front binding shown in FIG. 1,

FIG. 3 is a force diagram showing in diagrammatic view, the direction and points of impingement of the forces acting on the front binding, FIG. 15 is a plan view of another embodiment of locking arrangement, FIG. 16 is a side view of the locking arrangement of FIG. 15, FIG. 21 is a plan view of another embodiment of pivotable front binding, FIG. 22 is a side view of a detail of the front binding of FIG. 21, FIG. 25 is a plan view of a front binding as shown in FIG. 24 with a roller plate, FIG. 26 is a side view of the front binding shown in FIG. 25, FIG. 27 is a plan view of another embodiment of front binding having a roller plate, FIG. 28 is a side view of the front binding of FIG. 26, FIG. 30 is a front view of a front binding, FIG. 31 is a plan view of the front binding of FIG. 30, FIG. 34 is a plan view of the front binding of FIG. 33, FIG. 35 shows the front binding of FIG. 34 in a different working position, FIG. 36 is a side view of a further embodiment of front binding, FIG. 40 is a front view of a front binding having a pivotable abutment on the sole clamp, FIG. 41 is a plan view of the embodiment of FIG. 40, FIG. 42 is an enlarged scale side-view of the heel binding shown in FIG. 29, FIG. 43 shows the heel binding of FIG. 42 with the front mounting thrust forwards and upwards, FIG. 44 is a plan view of the heel binding shown FIGS. 42 and 43.

FIG. 55 is a plan view of another embodiment of front binding, FIG. 56 is a side-view of the front binding shown in FIG. 55, FIG. 61 is a plan view of another embodiment of front binding, FIG. 62 is a side-view of the front binding of FIG. 61.

DETAILED DESCRIPTION OF PREFERRED EMBODIMENTS

Figure 4:
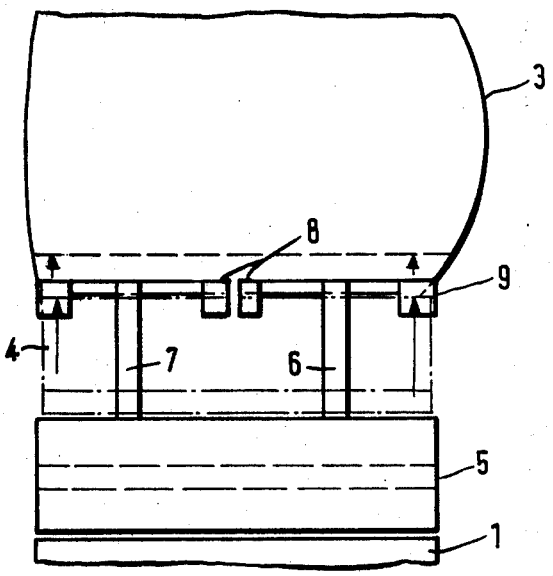
FIG. 4 is a front view of the front binding when partly released as a result of a backward fall.

Referring now to the drawings, as shown in FIGS. 1 to 7, a foot-plate 2, on which the sole 4 of a ski-boot 3 rests, is arranged on a ski 1. A front binding connected to a foot-plate has a pivot shaft 5 extending transversely to the longitudinal direction of the ski underneath the plane of the bottom of the sole of the boot, on which sole clamps 6 and 7 are mounted to tilt. As FIG. 1 in particular shows, the sole clamps 6 and 7 can be pivoted through an angle of more than 80° from the upward pointing, locked boot-securing position shown in solid lines in FIG. 1 to a released position shown in broken lines in which they point forward in the direction of the point of the ski.

The sole clamps have an abutment 8 to hold the ski boot 3 against movement in the longitudinal direction of the ski and which rests against the front or toe of the sole of the boot. The sole clamps 6 and 7 also have lugs 9 which hold the sole of the boot in position in a direction perpendicular to the plane of the sole and which also grasp the toe portion of sole 4 of the boot at the sides.

As FIG. 3 in particular shows, the abutments 8 of the sole clamps 6 and 7 are spaced from the pivot shaft 5 a distance less than the distance the lugs 9 are spaced from the pivot shaft 5. Thus, to exceed the pressure threshold of the locking arrangement which holds the sole clamps in the locked position and which will be explained below, less force is needed when the force is applied to the lugs than when force is applied to the abutments 8.

As FIGS. 1 and 2 in particular show, in the event of a head-on impact the sole 4 of the boot exerts a force on the abutments 8 so that, if a specific pressure threshold is exceeded, the sole clamps 6 and 7 fold forwards to the released position shown in broken lines in which the clamps are disposed below the plane of the upper surface of footplate 2, that is, below the bottom of the ski boot sole. With the clamps in released position, the ski boot 3 can slide towards the point of the ski without hindrance, as indicated by the broken line position shown for the ski-boot 3 in FIG. 1. It is important that the sole clamps, in particular the abutments 8 and the lugs 9 holding the ski boot, should move upwards and away from the ski boot (the arcs marked X and XX in FIG. 1) at the beginning of their tilting movement, so that when the boot slides forward the sole 4 will not catch on the clamps 6 and 7. Slide rollers 10 arranged in the foot plate are rotatable about axes extending transversely to the longitudinal direction of the ski and reduce the friction between the sole 4 of the boot and the foot-plate upper surface of 2.

Figure 5:
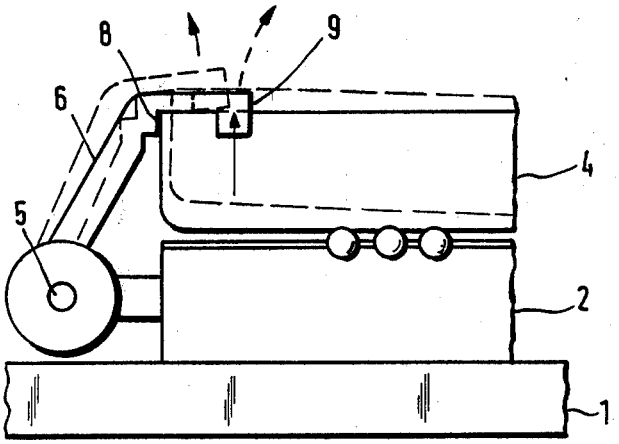
FIG. 5 is a side-view of the front binding when partly released as a result of a backward fall or a fall to the side.

As FIGS. 4 and 5 show, in the event of a backward fall, the sole 4 of the ski-boot exerts an upwardly directed force on the lugs 9 of the sole clamps 6 and 7, with the result that if a specific pressure threshold is exceeded the sole clamps tilt forwards. Since the point at which force is applied to the lugs 9 of the sole clamps is further from the pivot shaft 5 than would be the case with a forward fall after a head-on impact, where the force would be applied to the abutments 8, less force is required to release the front binding in the case of a backward fall. Also, the magnitude of the force required to release the front binding can be altered by moving the lugs 9 towards the abutments 8.

Figure 7:
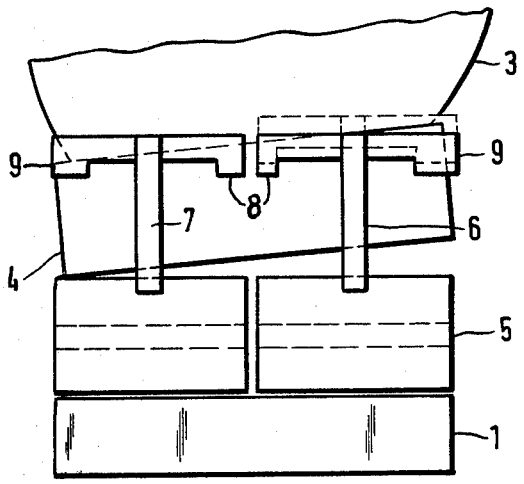
FIG. 7 is a front view of the front binding when partly released as a result of the ski boot tilting to the side.
Figure 6:
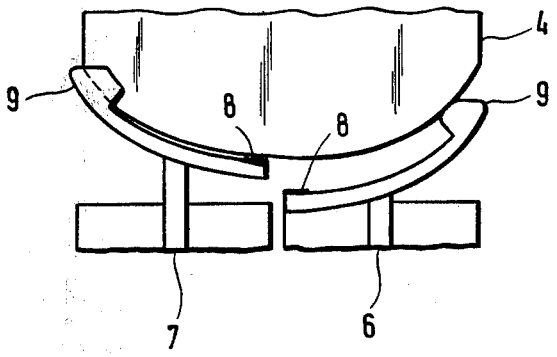
FIG. 6 is a plan view of the front binding when partly released as a result of the ski boot tilting to the side.

The same is also true if the ski-boot tilts sideways, as shown in FIGS. 6 and 7, although in contrast to forward and backward falls initially only one sole clamp tips forward in any given case.

Figure 8:
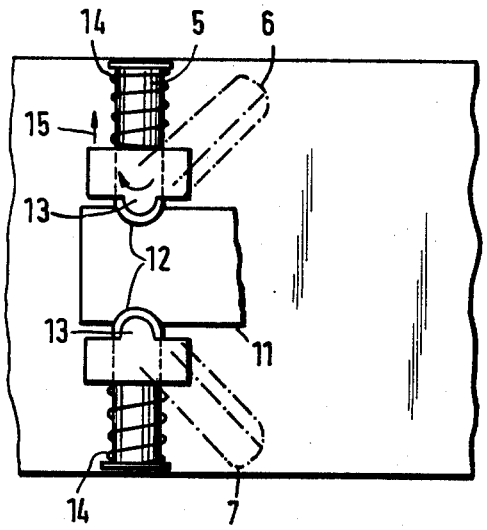
FIG. 8 is a plan view of an arrangement for locking the sole-clamps.

In FIG. 8 the pivot shaft 5 is securely held in a central mounting 11. Arranged to rotate on the pivot shaft are schematically indicated sole clamps 6 and 7 which are displaceable axially along the shaft and which have projections 13 engaging in recesses 12 in the central mounting 11. The sole clamps 6 and 7 are held in the locked position by pre-tensed or pre-stressed springs 14 that is springs having an initial preset stress, arranged on the pivot shaft. In this embodiment, the sole clamps are on the one hand rotatable from the locked position to the released position by forces exerted on them in the forwards or upwards direction and on the other hand are also releasable by lateral forces, acting for example in the direction of the arrow marked 15, exerted on the sole clamps.

Figure 9:
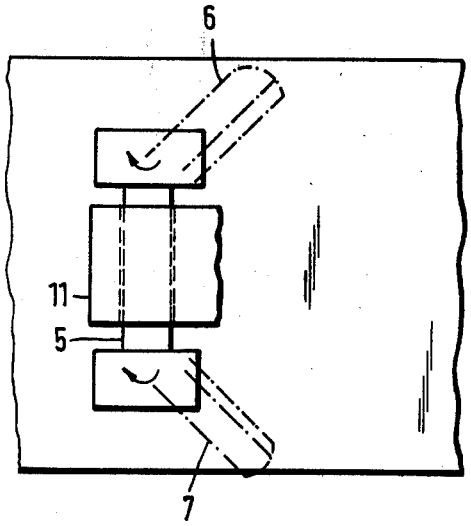
FIG. 9 is a plan view of sole-clamps arranged on a common pivot shaft.

In FIG. 9 sole clamps 6 and 7 are arranged on a common pivot shaft 5 which is mounted to rotate in a central mounting 11. With this embodiment both the sole clamps release simultaneously.

Figure 10:
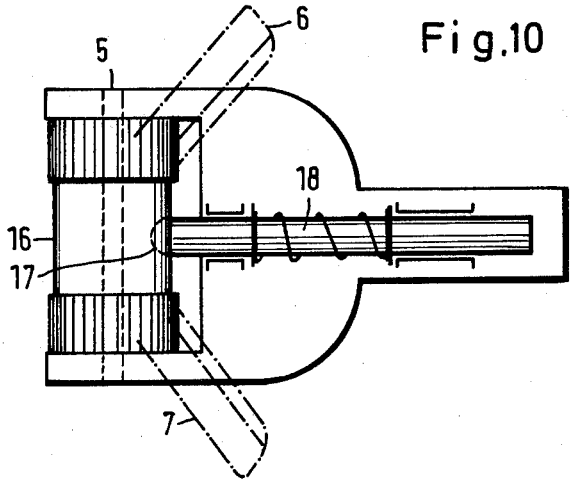
FIG. 10 is a plan view of another arrangement for locking the sole-clamps.
Figure 11:
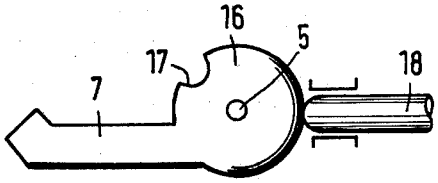
FIG. 11 is a side view of the locking arrangement of FIG. 10 in the released position.

In FIGS. 10 and 11, the sole clamps 6 and 7, arranged on a pivot shaft 5, are connected together by a cylinder 16 in which is situated a recess 17. A spring-loaded pin 18 which holds the sole clamps 6 and 7 in the locked position engages in the recess 17. In the released position the point of the spring-loaded pin 18 lies against the circumference of the cylinder 16 in a retracted position as shown in FIG. 11.

Figure 12:
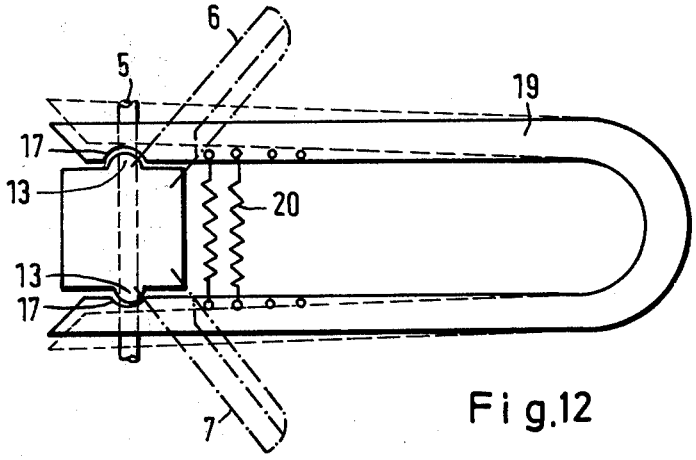
FIG. 12 is a plan view of another embodiment of locking arrangement.

In FIG. 12 sole clamps which are connected to one another are arranged to rotate on a pivot shaft 5. The sole clamps 6 and 7 have projections 13 which engage in recesses 17 in the ends of the side-arms of an U-shaped spring clip 19. The ends are connected together by springs 20 whose arrangement can be altered to alter the releasing force required.

Figure 13:
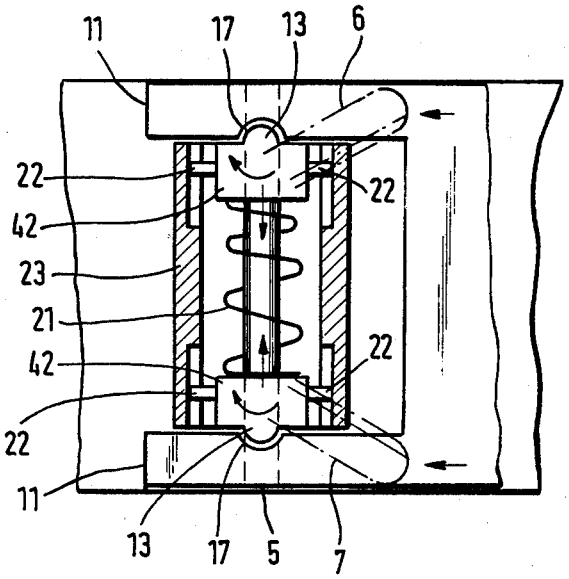
FIG. 13 is a plan view of yet another embodiment of locking arrangement.
Figure 14:
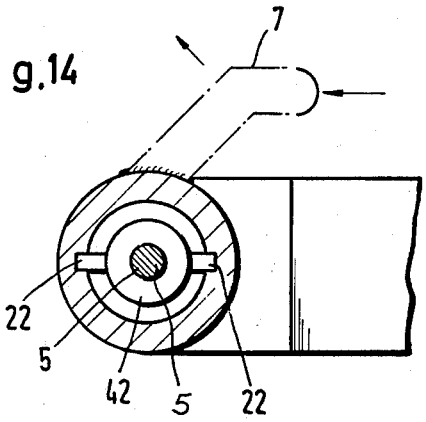
FIG. 14 is a side view of a detail of the locking arrangement shown in FIG. 13.

In FIGS. 13 and 14, locking discs 42, on which are mounted sole clamps 6 and 7 connected together by a sleeve 23, are arranged to be rotatable and displaceable in the axial direction on a pivot shaft 5. The locking discs 42 have projections 13 which engage in recesses 17 in lateral mountings 11. A pre-loaded compression spring 21 is arranged on the pivot shaft 5 between the locking discs 42 and holds the locking discs in the locking position. The locking discs 42 have guide pins 22 which are guided in recesses in the sleeve 23 connecting the two sole clamps 6 and 7.

Due to the fact that the two sole clamps 6 and 7 are connected by the sleeve 23, the tilting movement of one sole clamp is transmitted to the other so that both sole clamps are always moved to the released position simultaneously.

In the embodiment of front binding shown in FIGS. 15 and 16, the two sole clamps 6 and 7 are connected together by pretensed torsion and compression springs 24 which are connected centrally to a sleeve 23. With this front binding, if one sole clamp releases the other is released also by the torsion and compression springs. The pre-tensed torsion and compression springs resiliently absorb minor forces which do not cause release, as indicated in broken lines in FIG. 16.

Figure 17:
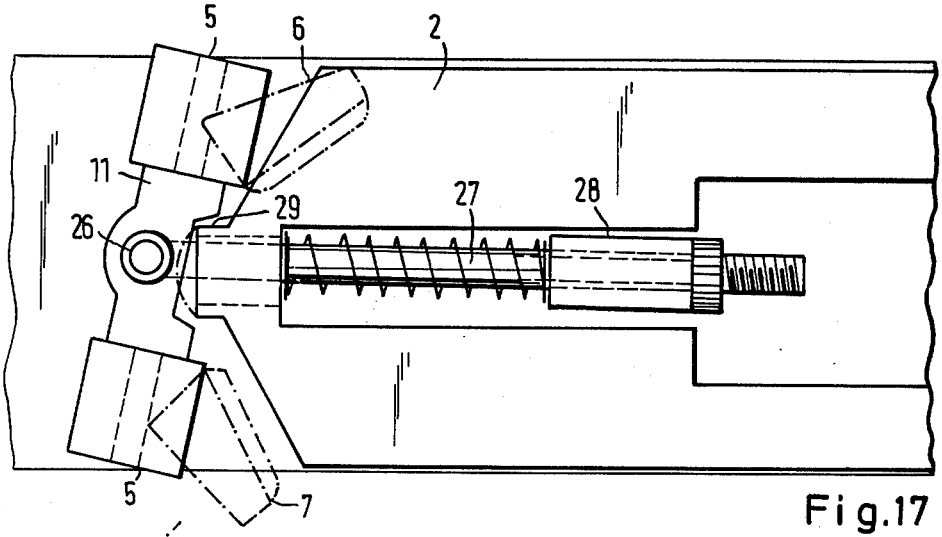
FIG. 17 is a plan view of a front binding which is able to pivot about a shaft perpendicular to the surface of the ski and which has sole-clamps which can be tilted forward.
Figure 18:
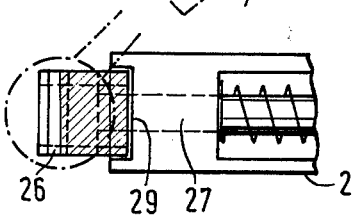
FIG. 18 is a side view of a detail of the front binding of FIG. 17.

In FIGS. 17 and 18, the mounting 11 carrying the pivot shaft 5 for the sole clamps 6 and 7 is arranged to rotate about a shaft 26 perpendicular to the plane of the ski. The shaft 26 is mounted at the end of a spring-loaded rod 27 displaceably arranged in the foot plate 2 which at the other end has a setting nut 28 to allow the force exerted by the spring to be adjusted. At the end adjacent the mounting 11, the foot plate 2 has a bearing face or stop 29 against which the mounting 11 normally is held by the force of the spring in a central position in which the pivot shaft 5 carried by mounting 11 extends transversely of the ski. As shown in FIG. 17, once the biasing force of the spring is overcome, the mounting 11 moves longitudinally of the ski and is free to pivot about shaft 26. In the case of this front binding, the mounting 11 is mounted to be displaceable in the longitudinal direction of the ski, and the front binding does not begin to move longitudinally or pivot until a specific, pre-set pressure threshold is exceeded.

Figure 19:
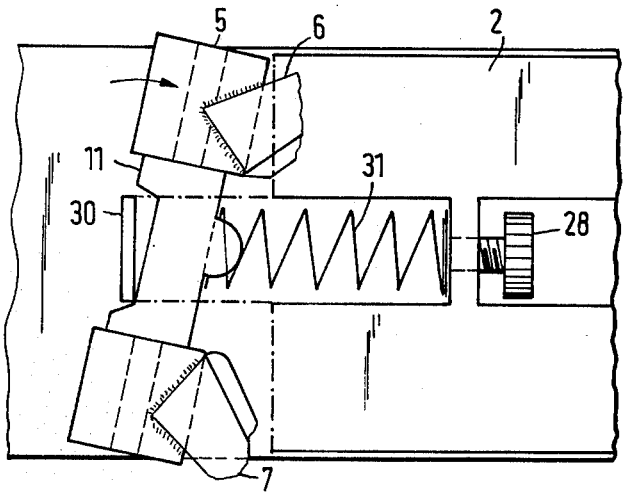
FIG. 19 is a plan view of another embodiment of pivotable front binding.
Figure 20:
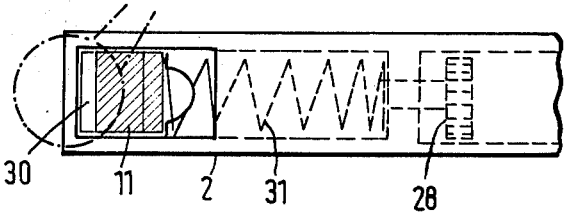
FIG. 20 is a side view of a detail of the front binding of FIG. 19.

In the embodiment of front binding shown in FIGS. 19 and 20, the mounting 11 carrying the pivot shaft 5 for the sole clamps 6 and 7 rests against a front bearing plate or stop 30. A pre-tensed spring arranged in a recess in the foot plate 2 normally holds the mounting 11 in the central position. As FIG. 19 in particular shows, when moved from its central position, the mounting 11 tilts about one of the lateral edges of the bearing plate 30. A setting screw 28 is used to alter the biasing force of the spring.

In the embodiment of front-binding shown in FIGS. 21 and 22, the foot plate 2 has pig-like guides 32 arranged parallel to the edges of the ski at a distance from the central bearing face 29 which are guided in recesses 33 in the pivoting mounting 11. Thus, the mounting 11 can only be pivoted about the shaft 26 after it is been moved in the longitudinal direction of the ski and after the recesses 33 have been disengaged from the peg-like guides 32, the mounting 11 being supported against the edges of the bearing face 29.

Figure 23:
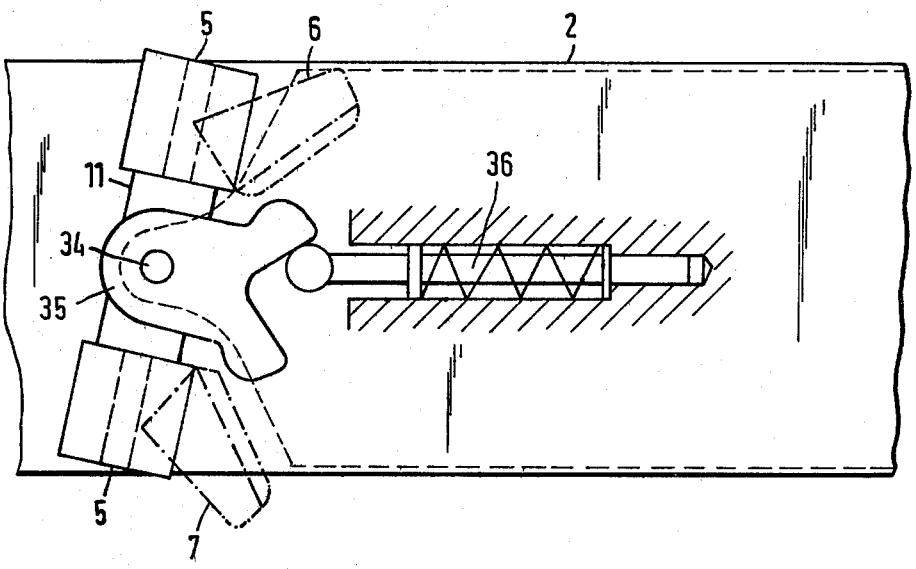
FIG. 23 is a plan view of yet another embodiment of pivotable front binding.
Figure 24:
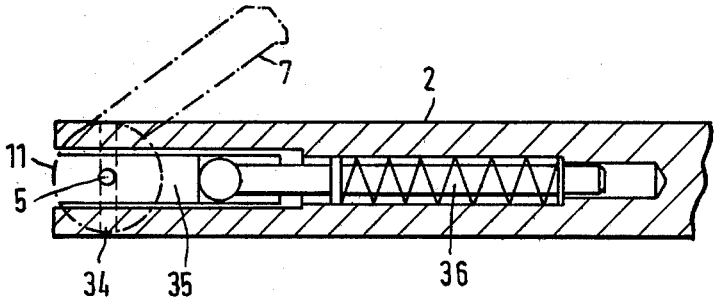
FIG. 24 is a side view of a detail of the front binding of FIG. 23.

In the embodiment of front binding shown in FIGS. 23 and 24, the mounting 11 carrying the pivot shaft 5 for the sole-clamps 6 and 7 is mounted to rotate about a shaft 34 secured to the ski. Securely connected to the mounting 11 is a cam plate 35 having a V-shaped track in which engages one end of a spring-loaded rod 36 displaceably mounted in the foot plate 2, thus holding the mounting 11 in a central position.

In FIGS. 25 and 26, in a front binding as shown in FIGS. 23 and 24, a roller plate 37 is arranged on the foot plate 2 and is hinged via an arm 38 to the mounting 11 for the pivot shaft 5 carrying the sole clamps 6 and 7.

Also, two parallel leaf springs 39 are fixed to the foot plate 2 at a distance from one another. At the other end the leaf springs 39 are hinged to the roller plate 37. In the roller plate are arranged slide rollers 40 rotatable about axes extending transversely to the longitudinal direction of the ski, on which the ski-boot can roll forward. Slide rollers 41 rotatable about axes extending in the longitudinal direction of the ski are also arranged in the roller plate 37 and these roll on the foot-plate 2 transversely to the longitudinal direction of the ski and thus reduce the friction between the roller plate 37 and the foot-plate 2, in particular when loads are exerted by the ball of the foot.

The embodiment of front binding shown in FIGS. 27 and 28 differs from the embodiment shown in FIGS. 25 and 26 in that the leaf springs 39, arranged on the foot-plate 2 and hinged to the roller plate 37, do not lie parallel to one another. As a result the roller plate swings in an arc. The leaf springs 39 increase the centralising force on the front binding, which is an advantage.

As a result of the fitting of the roller plate 37, rotary movements by the toe of the ski-boot are facilitated because the part of the boot corresponding to the ball of the foot rests on the roller plate and in this way the rotary movement of the mounting 11 of the front binding is assisted.

Figure 29:
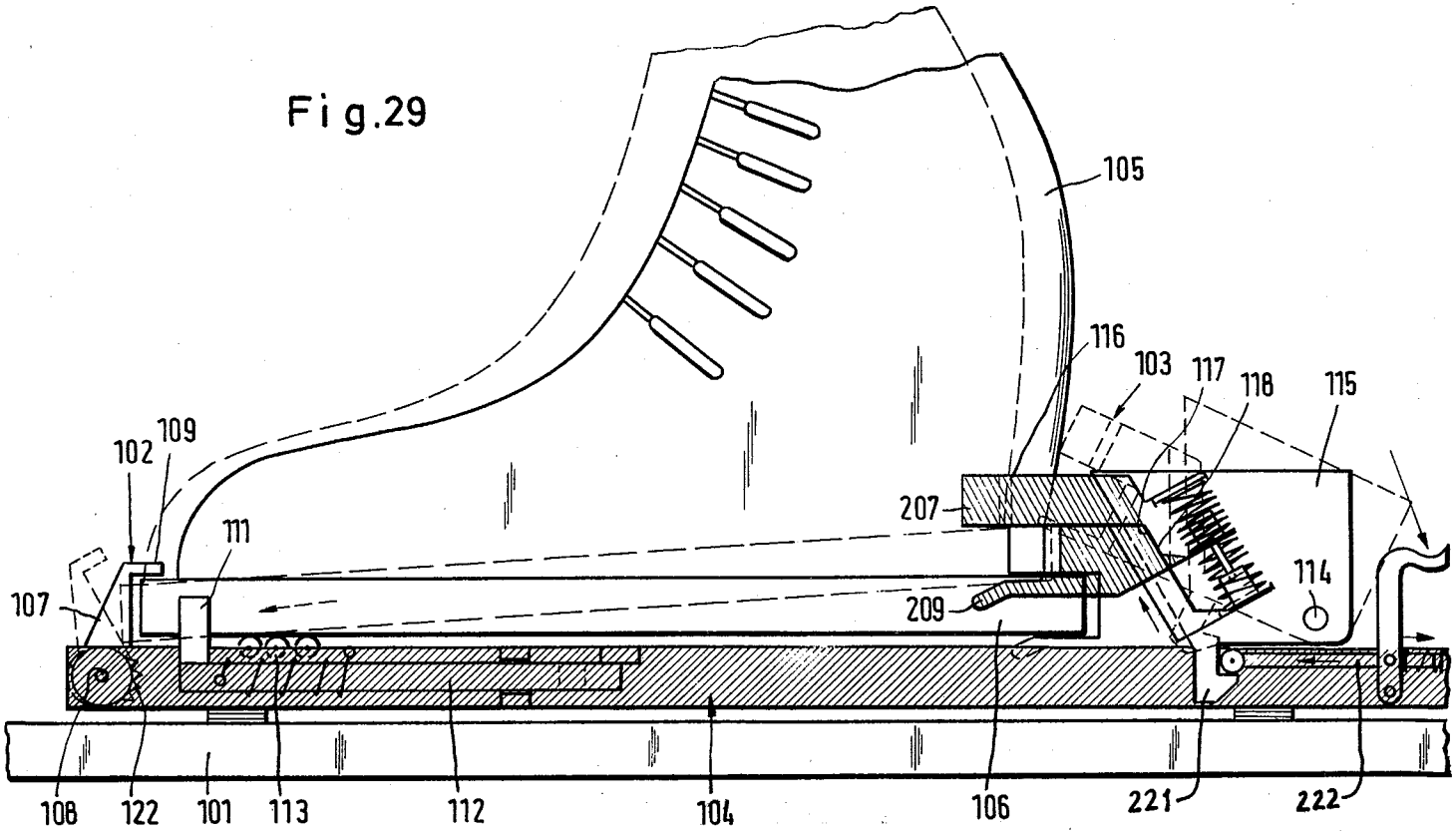
FIG. 29 is a side view of an embodiment of the invention that includes a heel binding.

In FIG. 29, a ski binding which comprises a front binding 102, a heel binding 103 and a foot plate 104 is mounted on a ski partly shown at 101. The front binding 102 and heel binding 103 hold a ski-boot 105 whose sole 106 rest on the foot plate 104. The front binding 102 has a sole clamp 107 which is arranged in front of the toe of the ski-boot 105 beneath the plane of the bottom of the sole and which can tilt forwards about a pivot shaft 108 extending transversely to the longitudinal direction of the ski. In the locked position the top part 109 of the clamp grasps the sole of the toe portion of the boot at the extreme front. The sole of the boot is released however when the sole clamp 107 tilts forward, as indicated in broken lines. In so doing, the sole clamp 107 describes a rising arc, as a result of which the toe of the boot is released forwards and upwards.

As FIG. 32 in particular shows, the sole clamp 107 is able to tilt forwards through an angle of more than 80° and is below the plane of the bottom of the ski boot sole, so that the boot is free to slide forward without obstruction in the direction of arrow 110 as soon as the sole clamp has tilted forward.

As shown in FIG. 29, at the sides of the sole 106 of the boot are arranged outwardly tilting abutments 111 which are mounted on a spring-loaded rod 112 displaceable in the longitudinal direction of the ski. Between the abutments 111, roller arrangements 113 are arranged in the foot plate 114 which make it easier for the ski-boot 115 to move in the direction of the point of the ski.

The heel binding 103 comprises a rear part 115 which is able to tilt about a shaft 114 extending transversely to the longitudinal direction of the ski, and a front part which is arranged to be displaceable in relation to the rear part. The contacting faces 117 and 118 of the front part 116 and the rear part 115 are inclined forwards and upwards from the surface of the ski. What is achieved by this arrangement is that the ski-boot 105 is moved in the direction of the point of the ski when the heel of the ski-boot, and thus the front part 116 of the heel binding, is raised by a forward fall from a standing position. In the event of such a fall from the standing position, the front part 116 bears against the rear part 115 of the heel binding, the rear face 117 of the front part 116 sliding upwards and forwards along the front face 118 of the rear part 116.

Because of the pressure which is generated in this way against the sole clamp 107, as described above, the clamp tips forward and releases the ski boot, so that the front binding opens when the skier falls forward from a standing position.

As is shown in FIGS. 30 and 31, the sole clamp 107 is held in position by means of laterally engaging pins 119, balls, catches or the like which project into corresponding recesses 120 in the sole clamp, with a compression spring 121, the force exerted by which is adjustable, pressing pins 119 against the sole clamp 107. Only when the thrust acting on the sole clamp 107 is greater than the holding force exerted by pins 119 does the sole clamp 107 tip forwards, so that the sole of the ski-boot can slide forwards and out.

To ensure that the sole clamp 107 tilts sufficiently far forward, part-rings of teeth 122 (FIGS. 29 and 32) are provided of which the points are engaged by the sole of the ski boot as it slides forward, in order to drive the sole clamp.

Figure 32:
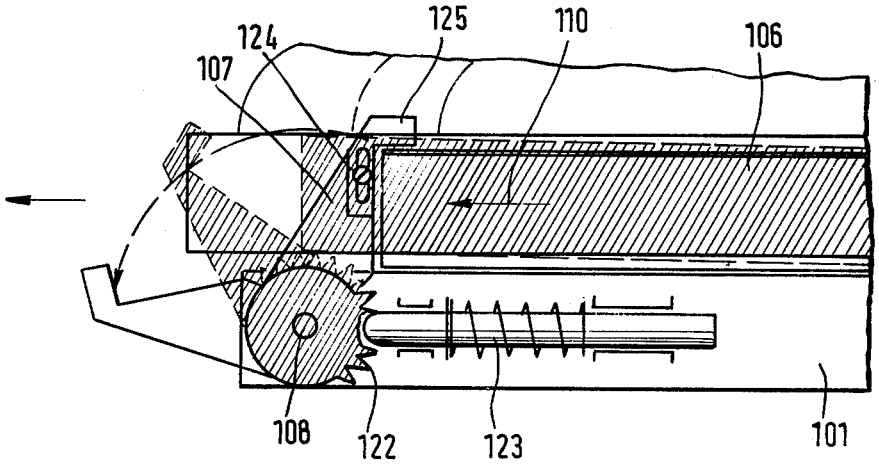
FIG. 32 is a side view of another embodiment of front binding.

The embodiment shown in FIG. 32 also has a retainer pin 123 which is spring loaded and which presses against the sole clamp 107 from behind, so that the clamp is locked until the pressure on it exceeds a specific threshold value whereupon the sole clamp 107 frees itself from the retainer pin 123 and can tilt forwards.

In FIG. 32, an adjusting device 124 is provided to allow the height of the top 125 of the sole clamp 107 to be adjusted to suit the height of the sole 106 of the ski-boot.

Figure 33:
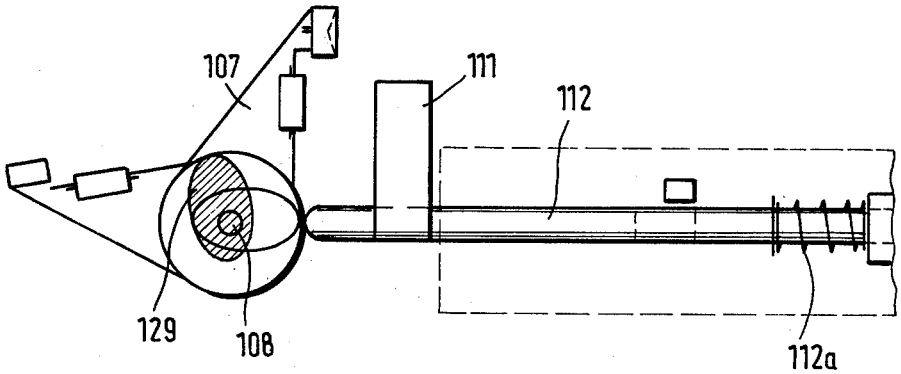
FIG. 33 is a side view of another embodiment of front binding.

FIGS. 33 to 35 show an embodiment in which the sole clamp 107 is connected to an eccentric 129 which co-operates with a rod 112 which carries the abutments 111 and which is functionally connected to a compression spring **112*a*. In the position shown in FIG. 34, the rod 112 is unable to move forward owing to the position of the eccentric 129, with the result that the abutment 111 cannot tilt sideways because a locking tab 130 connected to the rod 112 is not released by an abutment rod 131**.

If however the sole clamp 107 tilts forward, as is shown in FIG. 35, the eccentric 129 turns with it, so that the rod 112 can move forward under the prompting of compression spring **112*a* and the tab 130 is released and the abutment 111 can rotate outwards. At the time of resetting, the eccentric 129 forces the rod 112 back to the held position in opposition to the force from compression spring 112*a***.

Figure 37:
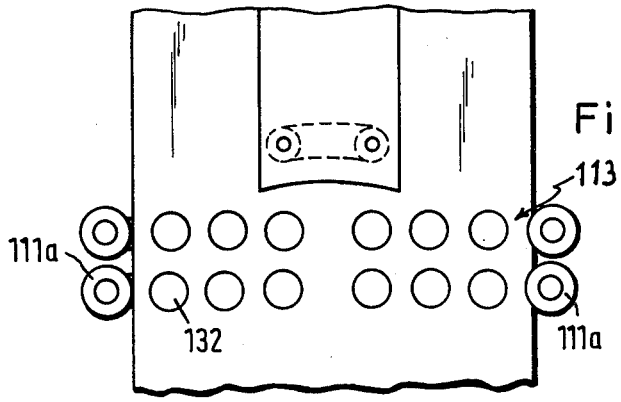
FIG. 37 is a plan view of the section of the footplate between lateral abutments.
Figure 38:
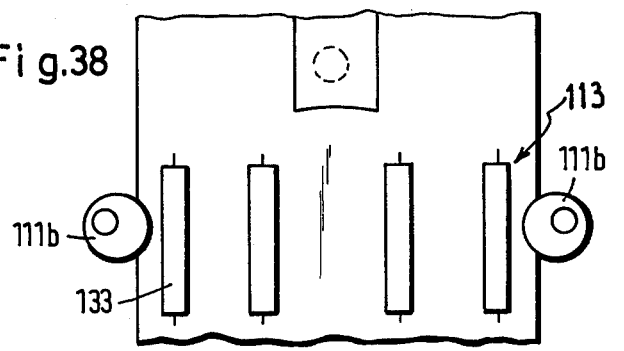
FIG. 38 is a view similar to FIG. 37 of another embodiment.
Figure 39:
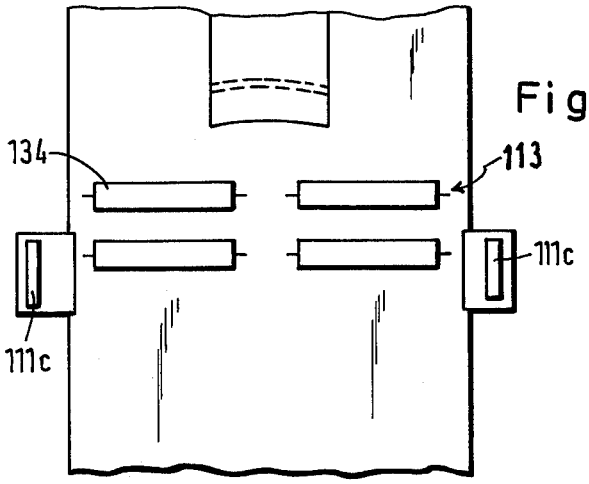
FIG. 39 is a view similar to FIG. 37 of a further embodiment.

FIGS. 37 to 39 show various embodiments of the abutments 111, which may be in the form of rollers **111*a* having vertical axes as shown in FIG. 37, eccentric rollers 111*b* as shown in FIG. 38, or slip-on caps 111*c* as shown in FIG. 39**.

The roller arrangement 113 is in the form of universally rotatable balls 132 in FIG. 37, in the form of rollers 133 having axes extending in the longitudinal direction of the ski in FIG. 38, and in the form of rollers 134 having axes extending transversely to the longitudinal direction of the ski in FIG. 39.

The design of the roller arrangement 113 enables the sole of the ski-boot to roll well both forwards and sideways with the minimum sliding resistance, which improves the releasing effect of the tilting movement of the sole clamp or of the lateral abutments.

In the case of the embodiment shown in FIG. 36, the top 125 of the sole clamp 107 is able to tilt about a shaft 135 extending transversely to the longitudinal direction of the ski, a spring 136 holding the top 125 in the locked position.

If the skier falls backwards from a standing position and thus forces the toe of the ski-boot against the top 125 of the sole clamp 107 with a force which is greater than the force which is exerted by the spring 136, the top 125 tips forward about the shaft 135 and releases the ski-boot.

In FIGS. 40 and 41, an abutment 137 is arranged on the sole clamp 107 and is able to pivot freely about a pivot shaft 138 perpendicular to the plane of the ski. The abutment 137 is of slightly curved configuration to match the toe of the boot and its purpose is to facilitate the release of the toe of the boot when the front binding is released sideways.

In FIGS. 42 to 44, the heel binding 103 shown in FIG. 29 includes a front mounting 116 which carries a heel clamp 207 for normally holding the heel portion of the ski boot sole on the ski and a heel plate 209 for normally supporting the bottom of the sole heel portion.

The heel binding 103 also has a rear part 115 which, together with the front mounting 116, can swing up from the surface of the ski 101 about a pivot shaft 114 extending transversely to the longitudinal direction of the ski.

At its rear end, the front mounting 116 has an inclined sliding face 117 which extends forward and upward from the surface of the ski at an angle. At the front end of the rear part 115 is situated a corresponding inclined sliding face 118. What is achieved in this way is that the front mounting 116 moves slightly towards the front binding 102 when it is forced upwards.

The front mounting 116 also has a projection 215, while the rear part 116 has a projection 216. Between these two projections 215 and 216 is arranged a compression spring 217 which acts in such a way that the front mounting 116 remains pressed downward and rearward against the surface of the ski 101 until a force greater than the force exerted by the spring thrusts the front mounting 116 upwards. Inside the spring 217 is arranged a device 218 which changes over the force exerted by the spring in the event of fast and slow falls. As shown in FIG. 44, the front mounting 116 has lateral guide grooves 219 into which guide fillets 220 on the rear part 115 project.

On the underside of the rear part 115 is situated a locking hook 221 which can leave the locked position shown in FIGS. 42 and 43 when a locking rod 222 is moved in the direction indicated by the arrow, which may for example be brought about by a ski-stick, as indicated in FIG. 29.

Figure 45:
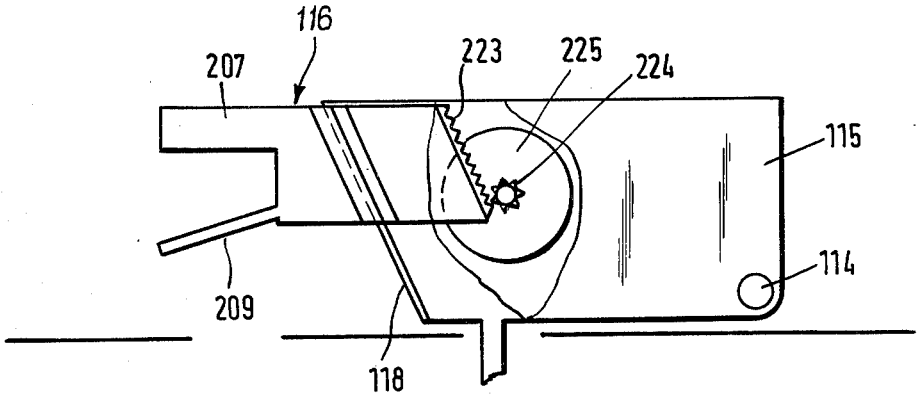
FIG. 45 shows another embodiment of heel binding.
Figure 46:
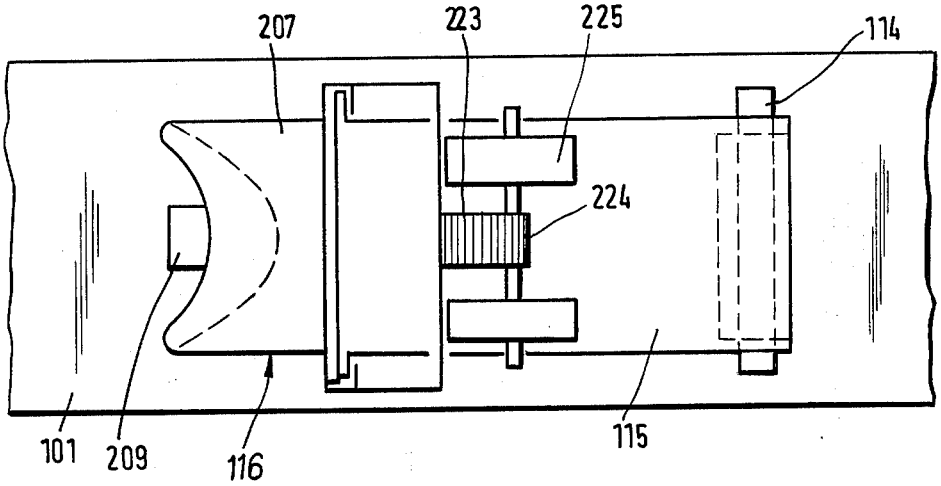
FIG. 46 is a plan view of the embodiment shown in FIG. 45.

In FIGS. 45 and 46, the rear edge of the front mounting 116 has a rack 223 in which a rotatably mounted gear-wheel 224 connected to the rear part 115 engages. The gear wheel 224 is connected to a fly-wheel 225 so that in this way the forward and upward movement of the front mounting 116 can be accelerated or braked. When a force is applied quickly, the fly-wheel 225 is turned faster, centrifugal force is developed and the motion of the gear wheel 224 is braked.

Figure 47:
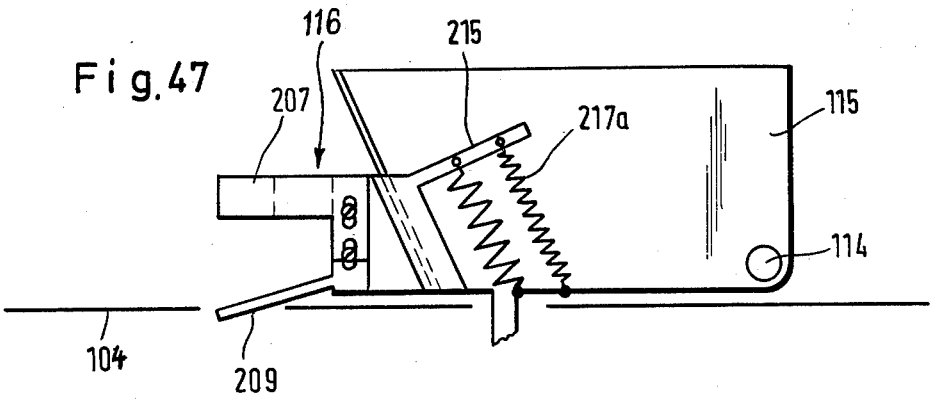
FIG. 47 shows another embodiment of heel binding.

In FIG. 47 the heel clamp 207 is arranged on the front mounting 116 in such a way that it can be adjusted vertically, so that the distance between the foot plate 104 and the sole clamp 207 can be adjusted to suit the thickness of the heel. In place of compression springs, tension springs 217*a* are used in this case, the force exerted by which can be adjusted by altering the attachment points.

Figure 48:
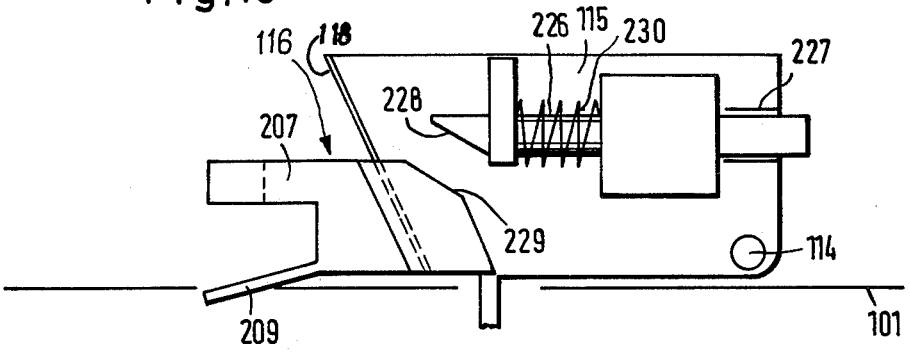
FIG. 48 shows another embodiment of heel binding.

In FIG. 48, the movement of the front mounting 116 along the incline 118 can be braked by a pin 226 which is movable in the longitudinal direction of the ski. The pin 226 is held in a guide 227 in the rear part 115. At its front end it has a bevel 228 which co-operates with a corresponding bevel 229 on the front mounting 116. A compression spring 230 holds the pin 226 in the advanced position. In this position the front mounting 116 is prevented from sliding upwards. If however the thrust force on the front mounting 116 is greater than the force exerted by the spring 230, the bevel 229 forces the pin 226 back and the front mounting 116 is released.

Figure 49:
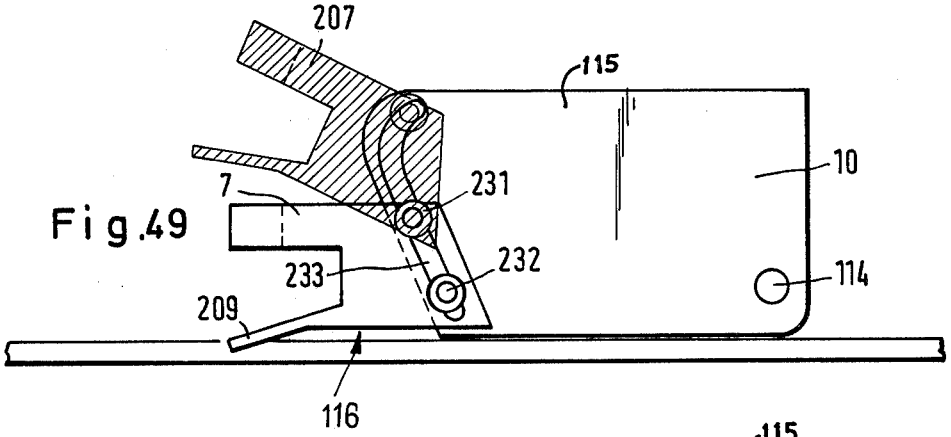
FIG. 49 shows a further embodiment of heel binding having guide rollers running in a guide track.

In the embodiment shown in FIG. 49, the front mounting 116 has lateral guide rollers 231, 232 which are guided in an inclined guide track 233 in the rear part 115. In FIG. 49 are shown the lowest and highest positions of the front mounting 116, from which it can be seen that as a result of the inclination of the guide track 233, when the front mounting 116 is forced upwards it is moved slightly towards the front binding 102, which means that the ski-boot held by it is also forced forwards towards the front binding.

As can also be seen in FIG. 49, the upper section of the guide track 233 curves backwards so that the sole clamp 207 will release more quickly and more satisfactorily.

Figure 50:
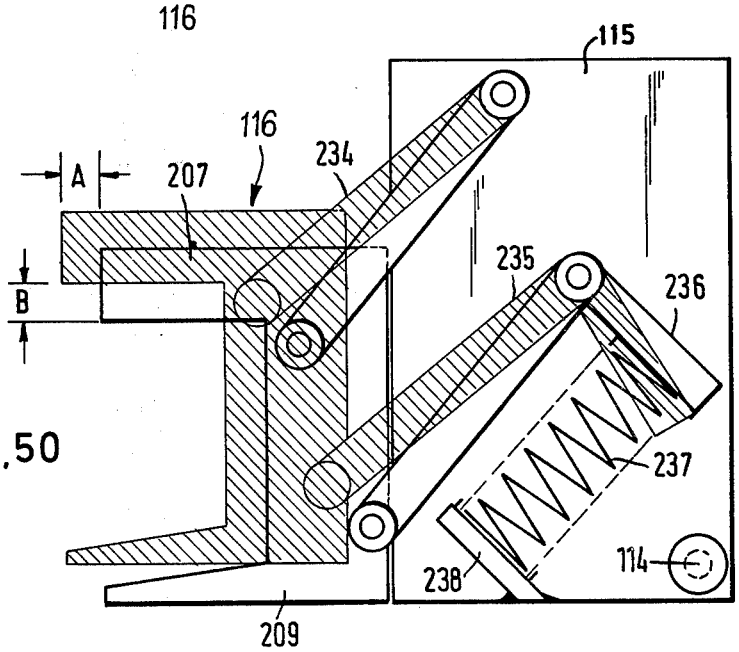
FIG. 50 shows a further embodiment having a front mounting arranged on swinging arms.

In the embodiment shown in FIG. 50, the front mounting 116 is pivoted to substantially parallel swinging arms or links 234, 235 which are pivoted to the rear part 115.

The lower swinging arm 235 is in the form of a bell crank. The bell crank arm 236 remote from the mounting 116 is connected at the end to a compression spring 237. At the other end the compression spring 237 bears against a projection 238 which is secured to the rear part 115. In this case too, the purpose of the compression spring is to hold the front mounting 116 downward and rearward against the surface of the ski until the upwardly acting force on the front mounting 116 is greater than the force exerted by the spring 237.

As FIG. 50 also shows, for a travel of the front mounting 116 of amplitude B the mounting moves towards the front binding 102 by a distance A, the movement of the front mounting being substantially linear inclined movement forward and upward relative to the ski.

Figure 51:
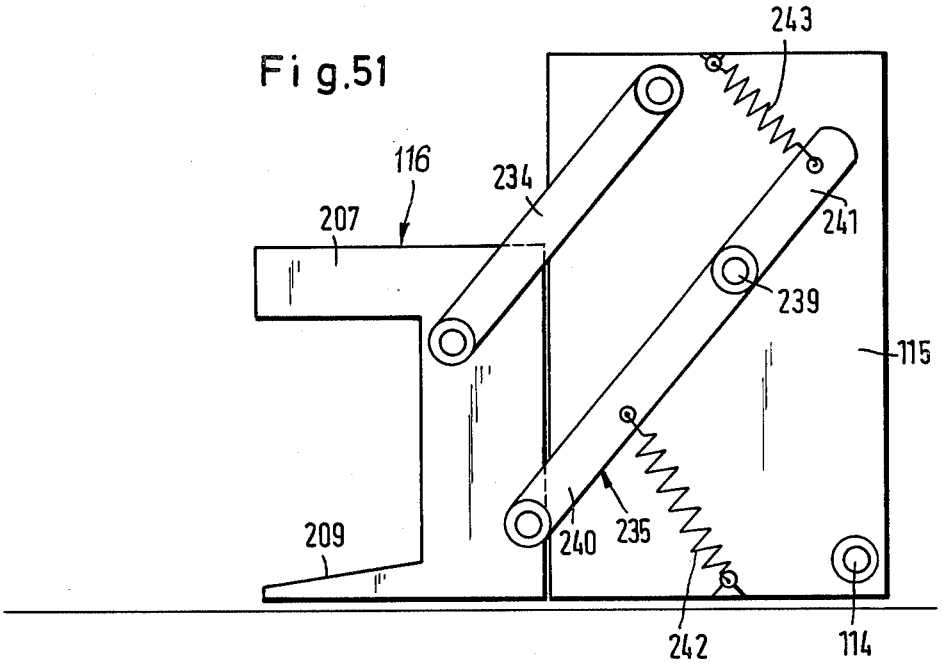
FIG. 51 shows a slightly different embodiment which is nevertheless similar to that of FIG. 50.

In the embodiment shown in FIG. 51, the lower swinging arm 235 is in the form of a straight lever, which is able to swing about a shaft 239. To at least one of the two sections 240 and 241 of the lever is secured the end of a spring 242 or 243 whose other end is connected to the rear apart 115.

Figure 52:
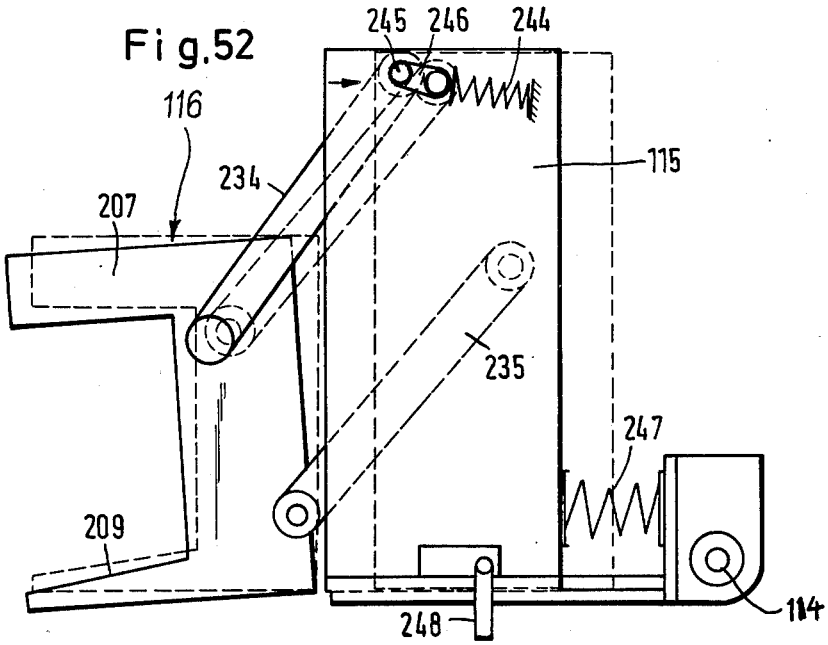
FIG. 52 shows a further embodiment which is similar to that of FIG. 50.

In the embodiment shown in FIG. 52, an upper compression spring 244 is provided which presses against a pivot shaft 245 for the upper swinging arm 234, the pivot shaft 245 being displaceable in an elongated guide hole 246. Also provided is a compression spring 247 which exerts a pressure in the direction of the front binding on the rear part 115 of the heel binding. An abutment 248 acts as a stop for the rear part 115.

What is achieved by the design of heel binding according to the invention is that in the event of a forward fall from a standing or stationary position the ski-boot is forced to press against the front binding with a force such that the front binding opens, without any need for the ski to be moving at a particular speed for this purpose or for the inertial force generated by the body of the skier which this produces.

Figure 53:
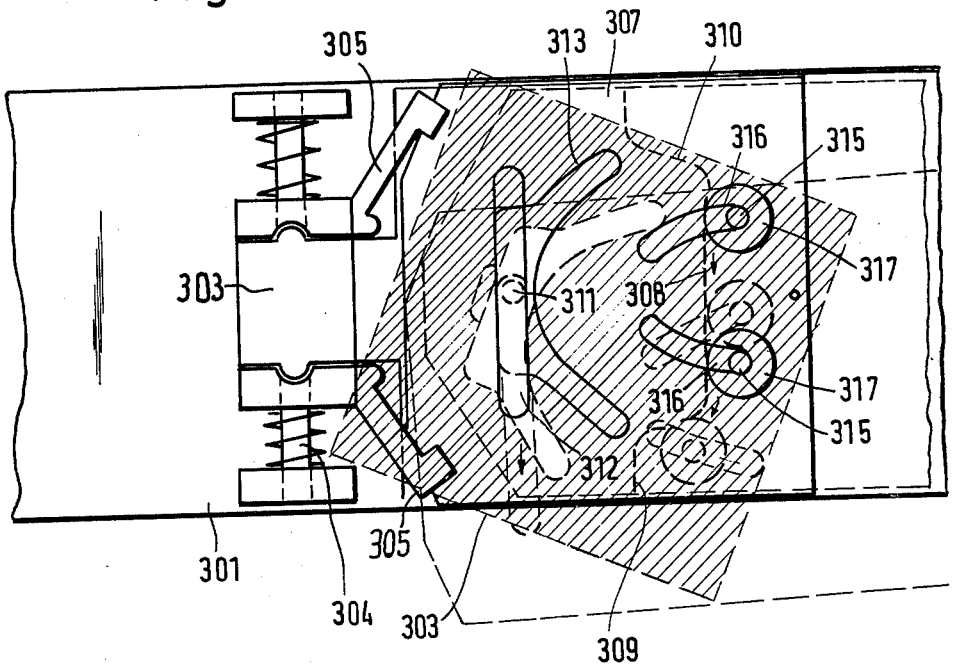
FIG. 53 is a plan view of a further embodiment of front binding according to the invention.
Figure 54:
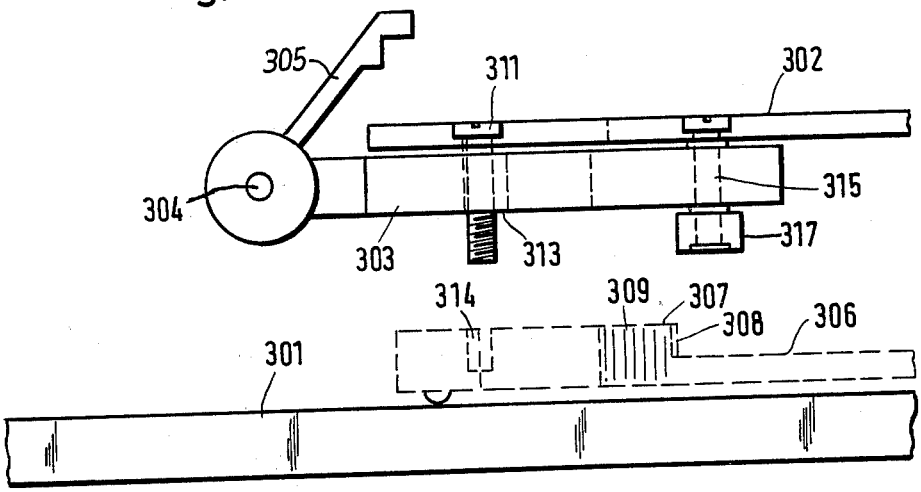
FIG. 54 is a side view of the front binding in the separated state.

In FIGS. 53 and 54, a foot plate 302 is pivotally arranged on a ski 301 in a plane parallel to the surface of the ski and is connected to a front binding. The front binding has a mounting 303 which carries sole clamps 305 far forward tilting about shaft 304.

Secured to the ski 301 is a bridge 306 carrying a cam plate 307. The cam plate has a central section 308 extending substantially transversely to the longitudinal direction of the ski and lateral sections 309 and 310 adjoining the central section which are set back towards the point of the ski.

A screw 311 projects through a curved cut-out 312 in the foot plate 302 and through another curved cut-out 313 in the mounting 303 into a recess 314 in the bridge 306 and thus connects the foot plate 302 and the mounting 303 to the bridge 306.

Near the end remote from the sole clamps 305, guide pins 315 are arranged in the mounting 303 of which the ends projecting above the mounting are guided in curved slots 316 in the foot plate 302 arranged at a distance from one another and of which the other ends projecting from the mounting 303 carry rollers 317 which are mounted to move against the cam plate 307.

The foot plate 302 is held in the central position by a holding device. As can be seen in FIG. 53, the mounting 303 carrying the shaft 304 and sole clamps 305 is then situated in the position shown in solid lines, when the guide pins 315 are situated at the ends of the slots 316 remote from the sole clamps and the rollers 317 rest against the central section 308 of the cam plate 307. As a result, the mounting carrying the sole clamps cannot perform pivoting movements in relation to the foot plate 302 and can only pivot through a small arc transversely to the longitudinal direction of the ski in conjunction with the foot plate.

If the foot plate 302 exceeds a certain angle of pivot as a result of a sideways deflecting force at the time of a fall, one of the rollers 317 moves into one of the setback lateral sections 309 or 310 of the cam plate 307, as is shown in broken lines in FIG. 53, the guide pin 315 moving in the slot 316. As a result the mounting 303 carrying the sole clamp 305 pivots in relation to the foot plate 302 in the opposite sense from the foot plate, as a result of which the ski-boot is released in the same direction as the force acting on it. As a result of the pivotal connection between the mounting 303 and the foot plate, it is ensured that the two parts assist each other in their pivoting movement.

In the case of the embodiment shown in FIGS. 55 and 56, the foot plate 302 is arranged to pivot about a shaft 318 extending perpendicularly to the surface of the ski which is fixed to the ski 301 near the mounting 303 carrying the sole clamps 305. The foot plate 302 is held in the central position by pre-tensed springs 319. In the foot plate, rollers 320 are arranged on shafts extending transversely to the longitudinal direction of the ski and the sole of the boot can roll towards the point of the ski on these rollers without friction when the sole clamps 305 have released and have tilted forwards about shaft 304 as shown in broken lines in FIG. 56. Also arranged in the foot plate 302 are rollers 321 rotatable about axes extending parallel to the longitudinal direction of the ski which roll on the surface of the ski. This reduces friction from the pivoting movement of the foot plate 302.

With this embodiment of front binding, the mounting 303 carrying the sole clamps and the foot plate also pivot in opposite senses from one another, as is shown in FIG. 55, thus assisting the ski-boot to slide out sideways or obliquely forwards.

Figure 57:
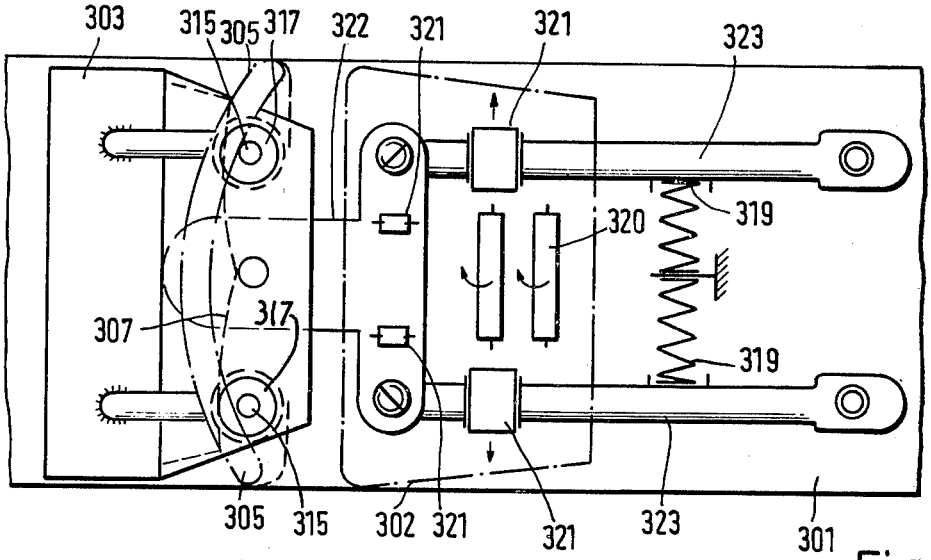
FIG. 57 is a plan view of a front binding having parallel bars carrying the foot plate.
Figure 59:
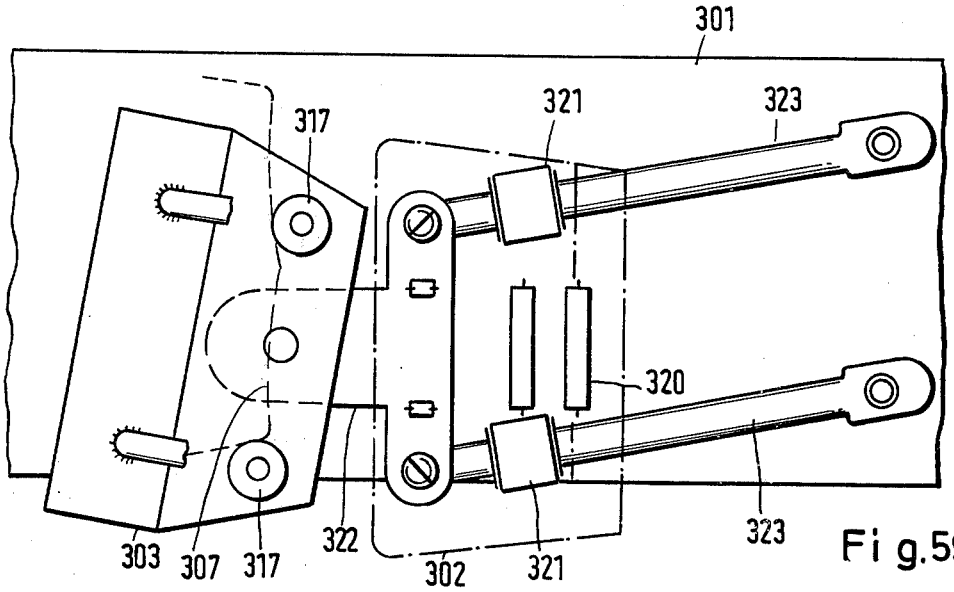
FIG. 59 shows the front binding of FIG. 57 in the released position.

In the embodiment shown in FIGS. 57 and 59, a mounting 303 carrying sole clamps 305 is hinged via a T-shaped link 322 to the ends of two parallel bars 323 arranged at a distance from one another transversely to the longitudinal direction of the ski. The bars are hinged at the other end to the ski 301. The mounting 303 has guide rods 315 carrying rollers 317 which roll on a cam plate 307 secured to the ski 301.

The bars 323 carry a foot plate 302 which is hinged to the bars 323 and which carries rollers 320 which are rotatable about axes extending transversely to the longitudinal direction of the ski.

Arranged to rotate on the bars 323 are rollers 321 which roll on a track 324 arranged on the ski 301. As a result the force exerted on the foot plate 302 by the part of the ski-boot corresponding to the ball of the foot is transferred by the rollers 321 to the surface of the ski and at the same time the friction from a pivoting movement of the ski boot is reduced.

Figure 58:
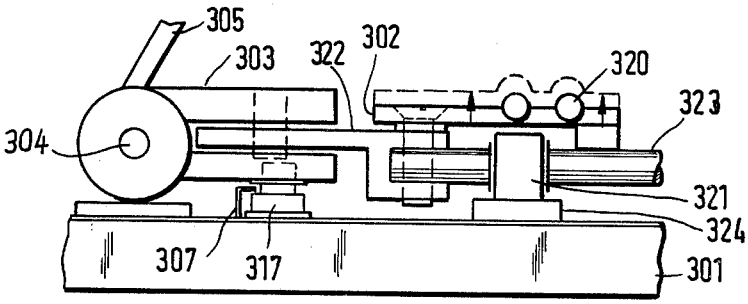
FIG. 58 is a side view of the front binding shown in FIG. 56.

The bars 323 are held in a central position by pretensed springs 319. The foot plate 302 is also adjustable vertically as indicated in broken lines in FIG. 58.

In this embodiment of front binding also, the foot plate and the mounting 303 carrying the sole clamps pivot in opposite senses, as shown in FIG. 59, with the foot plate performing a movement parallel to the ski which helps the ski boot to escape from the binding.

Figure 60:
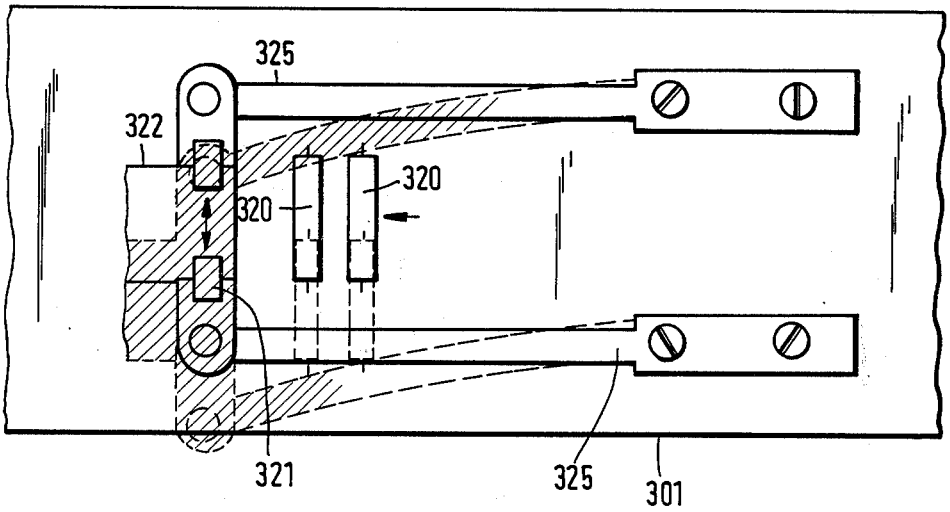
FIG. 60 is a plan view of another embodiment of front binding.

In the embodiment shown in FIG. 60, in place of the bars 323, leaf springs 325 are provided which are secured to one end to the ski 301. The leaf springs also carry rollers 320 which are rotatable about axes extending transversely to the longitudinal direction of the ski. The T-shaped link 322 which connects the leaf springs 325 to the mounting 303 (not shown) has rollers 321 rotable about axes extending parallel to the direction of the ski which facilitate sideways swinging movements.

The leaf springs 325 supplement the holding force and restorative force on the front binding, which is an advantage.

Figure 63:
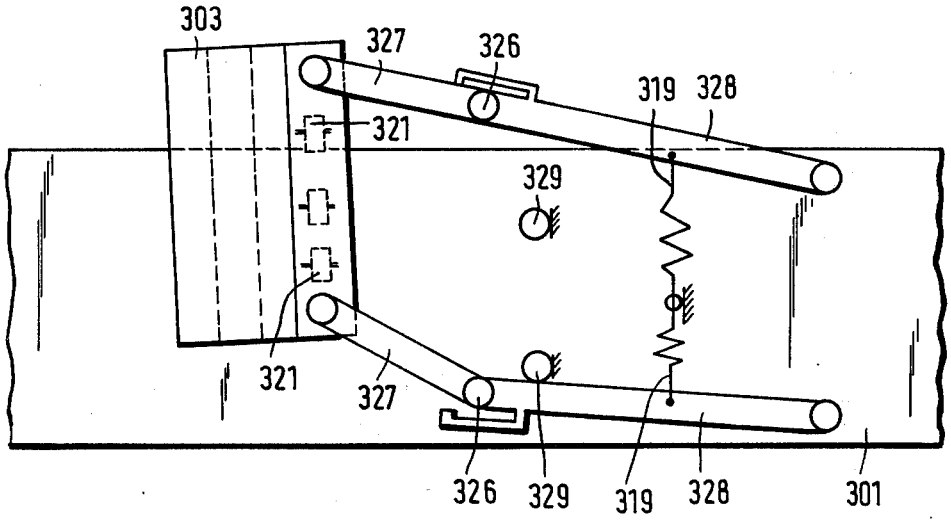
FIG. 63 shows the front binding of FIG. 61 in the partly released position.

In the embodiment of front binding shown in FIGS. 61 to 63, the rods 323 have respective bending joints 326, a front section 327 of each rod being connected to the mounting 303 and a rear section 328 of each rod being connected to the ski 301. At a distance from the rear sections 328 of the rods are provided abutments 329 secured to the ski. Connected to the bars 323 and to a pivot shaft 353 secured to the ski is a foot plate 302 which carries rollers 320 rotatable about axes extending transversely to the longitudinal direction of the ski. Also, rollers 321 which are rotatable about axes extending parallel to the longitudinal direction of the ski are provided on the mounting 303 and these facilitate swinging movements transverse to the longitudinal direction of the ski.

As FIG. 61 in particular shows, at small angles of pivot the joints 326 do not bend since the sections of the bars are held tensed in a straight line by the ski boot which is held in position by the clamps of the front binding and heel bindings. However, as soon as one of the sections 328 connected to the ski 301 strikes against an abutment 329 the associated section 327 connected to the mounting 303 folds towards the adjoining bar, with the result that the mounting 303 turns in the opposite sense from the sense in which the bars pivot, as shown in FIG. 63, and thus the ski-boot is released.

By altering the position of the bending joint 326 in the bars, the pivoting movement of the mounting 303 carrying the sole clamps 305 can be altered as desired. As FIG. 62 shows, the mounting 303 has a retainer lug 330 which co-operates with a retaining ledge 331 secured to the ski to prevent movement of the front binding in a direction perpendicular to the surface of the ski in the event of a backward fall.

I claim:

1. In a safety ski binding for releasably holding a ski boot on a ski, a heel binding normally holding the heel portion of the ski boot on the ski, and a front binding including:

toe clamp means having a first portion engageable with the toe portion of the ski boot for normally deterring forward movement of the ski boot lengthwise of the ski;

pivot means mounting said toe clamp means for swinging about an axis extending generally transversely of the ski and below the plane of the bottom of the ski boot sole between a boot-securing position in which said toe clamp means hold the toe portion of the ski boot in predetermined position relative to the ski and a released position in which said toe clamp means free the toe portion of the ski boot from the ski enabling substantial forward sliding movement of the ski boot along the ski; and locking means for normally maintaining said toe clamp means in boot-securing position but automatically shiftable for swinging of said toe clamp means into released position by the ski boot exerting on said toe clamp means a forward directed force in excess of a predetermined force.

2. In the ski binding defined in claim 1, the toe clamp means including a second portion engageable with the toe portion of the ski boot for normally deterring movement of the ski boot away from the upper surface of the ski.

3. In the ski binding defined in claim 2, each of the toe clamp means first and second portions being spaced from the pivot means axis, and the toe clamp means second portion being spaced from the pivot means axis a distance greater than the distance that the toe clamp means first portion is spaced from the pivot means axis.

4. In the ski binding defined in claim 2, the toe clamp means first portion including an arcuate member engageable with the ski boot sole.

5. In the ski binding defined in claim 1, the pivot means guiding the sole clamp means for swinging from boot-securing position forward and downward into released position.

6. In the ski binding defined in claim 1 or 5, the toe clamp means being below the plane of the bottom of the ski boot sole in released position for enabling unobstructed forward movement of the ski boot toward the point of the ski.

7. In the ski binding defined in claim 1, the toe clamp means including two toe clamps each carried by the pivot means and swingable forward and downward about the pivot means axis independently of the other toe clamp.

8. In the ski binding defined in claim 1, the toe clamp means including a toe clamp member, the locking means including a lock member connected to the ski, and means guiding one of the members for movement relatively toward and away from the other member, the locking means further including a recess in one of the members and a projection on the other member normally received in said recess and means biasing said two members relatively toward each other for normally maintaining said projection engaged in said recess.

9. In the ski binding defined in claim 1, the pivot means including a pivot shaft extending transversely of the ski, disposed below the bottom of the sole of the ski boot and carrying the toe clamp means.

10. In the ski binding defined in claim 9, the pivot shaft being located forward of the toe of the ski boot.

11. In the ski binding defined in claim 9, a mounting member connected to the ski and carrying the pivot shaft.

12. In the ski binding defined in claim 11, the mounting member being stationary relative to the ski.

13. In the ski binding defined in claim 11, the mounting member being movable relative to the ski.

14. In the ski binding defined in claim 13, means carrying the mounting member for swinging in a plane substantially parallel to the plane of the bottom of the ski boot sole.

15. In the ski binding defined in claim 14, a sole plate having an upper boot-supporting surface, means connecting said sole plate to the ski for swinging in a plane substantially parallel to plane of the bottom of the ski boot sole, and means connecting the mounting member and the sole plate for simultaneous swinging in opposite senses relative to the ski.

16. In the ski binding defined in claim 13, means carrying the mounting member for swinging about an upright axis.

17. In the ski binding defined in claim 16, the upright axis being stationary relative to the ski.

18. In the ski binding defined in claim 16, the upright axis being movable longitudinally of the ski.

19. In the ski binding defined in claim 13, 14, 16 or 18, means biasing the mounting member to a predetermined position relative to the ski with the pivot shaft carried by the mounting member extending transversely of the ski.

20. In the ski binding defined in claim 19, a stop stationary relative to the ski, the biasing means biasing the mounting member up against said stop.

21. In the ski binding defined in claim 11, the toe clamp means including a toe clamp member movable along the pivot shaft toward and away from the mounting member.

22. In the ski binding defined in claim 21, the locking means including a recess in one of the members and a projection on the other member normally engaged in said recess.

23. In the ski binding defined in claim 22, means biasing the toe clamp member toward the mounting member for normally maintaining the projection engaged in the recess.

24. In the ski binding defined in claim 23, the biasing means including a helical compression spring encircling the pivot shaft.

25. In the ski binding defined in claim 1, a sole plate connected to the ski and having an upper boot-supporting surface for supporting the part of the ski boot corresponding to the ball of the foot.

26. In the ski binding defined in claim 25, the sole plate being stationary relative to the ski.

27. In the ski binding defined in claim 25, the sole plate being swingable relative to the ski in a plane parallel to the plane of the bottom of the ski boot sole.

28. In the ski binding defined in claim 27, a cam plate secured to the ski, the sole plate being movable relative to said cam plate, one of said plates having at least one guide pin projecting therefrom toward the other plate and such other plate having a recess receiving the guide pin for guiding movement of the sole plate relative to the cam plate.

29. In the ski binding defined in claim 28, a roller carried by the portion of the guide pin received in the recess.

30. In the ski binding defined in claim 27, means biasing the sole plate to a predetermined position relative to the ski.

31. In the ski binding defined in claim 30, the biasing means including a leaf spring having one end portion connected to the ski and its other end portion connected to the sole plate.

32. In the ski binding defined in claim 31, the leaf spring extending longitudinally of the ski.

33. In the ski binding defined in claim 30, the biasing means including two leaf springs spaced apart transversely of the ski each having one end portion connected to the ski and its other end portion connected to the sole plate.

34. In the ski binding defined in claim 25, 27, 30 or 33, rollers carried by the sole plate for supporting the part of the ski boot corresponding to the ball of the foot on the sole plate.

35. In the ski binding defined in claim 34, at least some of the rollers being rotatable about axes extending transversely of the ski and supporting the boot on the sole plate.

36. In the ski binding defined in claim 34, rollers carried by the sole plate for supporting the sole plate on structure fixed to the ski.

37. In the ski binding defined in claim 1, the toe clamp means being swingable forward and downward from boot-securing position to released position through an angle of more than 80°.

38. In the ski binding defined in claim 1, the toe clamp means including two toe clamps each carried by the pivot means and spaced apart transversely of the ski and a sleeve generally coaxial with the pivot means and connecting the sole clamps for conjoint swinging between boot-securing position and released position.

39. In the ski binding defined in claim 38, the pivot means including a pivot shaft, the sole clamps being movable relatively toward and away from each other along said pivot shaft.

40. In the ski binding defined in claim 39, a helical compression spring encircling the pivot shaft and biasing the sole clamps relatively away from each other.

41. In the ski binding defined in claim 1, the heel binding including:

a heel clamp engageable with the heel portion of the ski boot for normally holding the ski boot heel portion on the ski;

a heel plate stationary relative to and below said heel clamp for normally supporting the heel portion of the bottom of the ski boot sole; and a front mounting carrying said heel clamp and said reel plate for inclined movement upward and forward relative to the ski to force the toe portion of the ski boot against the toe clamp means for effecting swinging of the toe clamp means to released position.

42. In the ski binding defined in claim 41, a rear mounting carrying the front mounting and including means guiding the front mounting for substantially linear movement upward and foreward relative to the ski.

43. In the ski binding defined in claim 42, means carrying the rear mounting and the front mounting for swinging about an axis extending transversely of the ski between a heel-securing position in which the heel clamp normally holds the heel portion of the ski boot on the ski and a heel-released position in which the heel clamp frees the heel portion of the ski boot from the ski.

44. In the ski binding defined in claim 42, the guiding means including an inclined sliding face on the rear mounting and an inclined sliding face on the front mounting and displaceable along said rear mounting inclined sliding face.

45. In the ski binding defined in claim 42, spring means biasing the front mounting downward and rearward relative to the ski.

46. In the ski binding defined in claim 45, the spring means being connected between the front mounting and the rear mounting.

47. In the ski binding defined in claim 42, the guiding means including at least two substantially parallel links pivotally connecting the front mounting and the rear mounting.

48. In the ski binding defined in claim 47, one of the links being in the form of a bell crank having one arm pivotally connected between the front mounting and the rear mounting, and spring means engaged against the other arm of said bell crank for biasing the front mounting downward and rearward relative to the ski.

49. In a safety ski binding for releasably holding a ski boot on a ski, a front binding normally holding the toe portion of the ski boot on the ski but automatically releasable for freeing the toe portion of the ski boot from the ski by the ski boot exerting on such front binding forward force toward the tip of the ski in excess of a predetermined force, and a heel binding including:

a heel clamp engageable with the heel portion of the ski boot sole for normally holding the heel portion of the ski boot on the ski;

a heel plate connected to said heel clamp for normally supporting the bottom of the heel portion of the ski boot sole; and means mounted on the ski for guiding said heel clamp and said heel plate for simultaneous substantially linear inclined movement away from the ski and toward the tip of the ski for forcing the toe portion of the ski boot forward against the front binding for automatically releasing the front binding.

50. In the ski binding defined in claim 49, the heel plate being stationary relative to the heel clamp.

51. In the ski binding defined in claim 49, the guiding means including a front mounting carrying the heel clamp and the heel plate, a rear mounting connected to the ski and means interconnecting the front mounting and the rear mounting and guiding the front mounting for substantially linear inclined movement away from the ski and toward the tip of the ski.

52. In the ski binding defined in claim 51, means carrying the rear mounting and the front mounting for conjoint swinging about an axis extending transversely of the ski between a heel-securing position in which the heel clamp normally holds the heel portion of the ski boot on the ski and a heel released position in which the heel clamp frees the heel portion of the ski boot from the ski.

53. In the ski binding defined in claim 51, the interconnecting means including an inclined sliding face on the rear mounting and an inclined sliding face on the front mounting and displaceable along said rear mounting inclined sliding face.

54. In the ski binding defined in claim 51, spring means biasing the front mounting downward and rearward relative to the ski.

55. In the ski binding defined in claim 54, the spring means being connected between the front mounting and the rear mounting.

56. In the ski binding defined in claim 51, the interconnecting means including at least two substantially parallel links pivotally connecting the front mounting and the rear mounting.

57. In the ski binding defined in claim 56, one of the links being in the form of a bell crank having one arm pivotally connected between the front mounting and the rear mounting, and spring means connected to the other arm of said bell crank for biasing the front mounting downward and rearward relative to the ski.

* * * * *

UNITED STATES PATENT AND TRADEMARK OFFICE

CERTIFICATE OF CORRECTION

PATENT NO. : 4,226,439
DATED : October 7, 1980
INVENTOR(S) : Bernhard Kirsch

It is certified that error appears in the above-identified patent and that said Letters Patent are hereby corrected as shown below:

Title page, [76] Inventor, cancel "LItzelholz" and insert ---Litzelholz---.

Column 17, line 33, cancel "34" and insert ---27---; line 62, cancel "reel" and insert ---heel---.

Signed and Sealed this

*Thirtieth* Day of *December 1980*

[SEAL]

*Attest:*

SIDNEY A. DIAMOND

*Attesting Officer*

*Commissioner of Patents and Trademarks*